US006739265B1

(12) United States Patent
Badger et al.

(10) Patent No.: US 6,739,265 B1
(45) Date of Patent: May 25, 2004

(54) EXPLOSIVE DEVICE WITH ASSEMBLED SEGMENTS AND RELATED METHODS

(75) Inventors: Farrell G. Badger, Mapleton, UT (US); Lyman G. Bahr, Payson, UT (US); Roger B. Clement, Spanish Fork, UT (US)

(73) Assignee: The Ensign-Bickford Company, Simsbury, CT (US)

( * ) Notice: Subject to any disclaimer, the term of this patent is extended or adjusted under 35 U.S.C. 154(b) by 0 days.

(21) Appl. No.: 09/407,616

(22) Filed: Sep. 28, 1999

Related U.S. Application Data

(63) Continuation-in-part of application No. 08/521,930, filed on Aug. 31, 1995, now Pat. No. 5,959,237.

(51) Int. Cl.[7] ..... F42C 1/02

(52) U.S. Cl. ..... 102/275.3; 102/275.4; 102/275.11; 102/275.12; 102/275.8; 102/318; 102/322

(58) Field of Search ..... 102/275.7, 275.3, 102/275.4, 275.8, 275.11, 275.12, 318, 332

(56) References Cited

U.S. PATENT DOCUMENTS

| | | | | |
|---|---|---|---|---|
| 1,652,961 A | * 12/1927 | Snelling | ..... | 102/275.7 |
| 2,622,528 A | 12/1952 | Lawrence | ..... | 102/24 |

(List continued on next page.)

FOREIGN PATENT DOCUMENTS

| | | | | |
|---|---|---|---|---|
| CA | 659660 | 3/1963 | ..... | 102/24 |
| FR | 2523713 | 9/1983 | ..... | F42B/1/02 |
| GB | 907878 | 10/1962 | | |
| GB | 918235 | 2/1963 | | |
| RU | 2039251 | 7/1995 | ..... | E21C/37/00 |

OTHER PUBLICATIONS

Gregory, Cedric Errol, *Explosives for North American Engineers* pp. 178–781 (1984).

(List continued on next page.)

*Primary Examiner*—Peter A. Nelson
(74) *Attorney, Agent, or Firm*—TraskBritt, PC

(57) ABSTRACT

A segmented explosive device capable of producing a shock wave front upon being exploded by a detonation impulse generated by a selectively operable control device and communicated to the explosive device by a transmission line coupled between the control device and the explosive device. The explosive device has a first charge segment and a second charge segment disposed in an assembled relationship. The first charge segment has a first abutment surface formed on a portion of the exterior thereof and a cavity recessed in the first abutment surface. An output end of the transmission line is received by the cavity and contacts the first charge segment. The cavity of the first charge segment can be configured to dispose explosive material in the path of a plasma zone propagating through voids internal of the explosive device to facilitate advance detonation of the explosive material before a shock wave front trailing the plasma zone reaches the explosive material. The second charge segment has a second abutment surface formed on a portion of the exterior thereof. In the assembled relationship of the first and second charge segments, the first and second abutment surfaces are disposed in contact with each other. The first and second charge segments may have complimentarily located nodules and receptacles or other complementary features on the abutment surfaces thereof for facilitating and stabilizing the disposition of the first and second explosive charge segments in the assembled relationship thereof. Methods for fabricating the segmented explosive device are also disclosed.

114 Claims, 18 Drawing Sheets

U.S. PATENT DOCUMENTS

| | | | | | |
|---|---|---|---|---|---|
| 2,628,559 | A | | 2/1953 | Jasse | 102/24 |
| 2,837,997 | A | | 6/1958 | Woods | 102/24 |
| 3,218,975 | A | | 11/1965 | Massey | 102/56 |
| 3,224,191 | A | | 12/1965 | Bratton | 60/35.6 |
| 3,296,794 | A | | 1/1967 | Nash | 60/39.47 |
| 3,316,842 | A | | 5/1967 | Schulz | 102/100 |
| 3,354,827 | A | | 11/1967 | Nelson | 102/24 |
| 3,407,736 | A | | 10/1968 | Beuschel | 102/99 |
| 3,437,038 | A | | 4/1969 | Newman | 102/24 |
| 3,438,325 | A | | 4/1969 | Martin | 102/24 |
| 3,491,688 | A | | 1/1970 | Clay et al. | 102/24 |
| 3,604,353 | A | | 9/1971 | Newman | 102/24 |
| 3,619,305 | A | | 11/1971 | De Brandon | 149/2 |
| 3,721,192 | A | | 3/1973 | McEwan | 102/24 |
| 3,756,025 | A | | 9/1973 | McCullough | 60/255 |
| 3,773,573 | A | | 11/1973 | Slykhouse | 149/21 |
| 3,779,819 | A | | 12/1973 | Thomas et al. | 149/2 |
| 3,789,760 | A | | 2/1974 | Griffith | 102/24 HC |
| 3,822,645 | A | | 7/1974 | Alexander | 102/102 |
| 3,880,080 | A | | 4/1975 | Cook | 102/24 |
| 3,994,756 | A | | 11/1976 | Hendrickson, Sr. et al. | 149/18 |
| 4,094,248 | A | | 6/1978 | Jacobson | 102/100 |
| 4,126,239 | A | | 11/1978 | Gehrig et al. | 215/6 |
| 4,291,624 | A | | 9/1981 | Sabranski | 102/307 |
| 4,293,351 | A | | 10/1981 | Johannes | 149/19.2 |
| 4,664,033 | A | * | 5/1987 | Burkdoll et al. | 102/275.11 |
| 4,678,524 | A | | 7/1987 | Cranney et al. | 149/21 |
| 4,696,233 | A | | 9/1987 | Paxton | 102/287 |
| 4,730,560 | A | * | 3/1988 | Bartholomew | 102/275.12 |
| 4,747,892 | A | | 5/1988 | Spencer | 149/20 |
| 4,753,170 | A | * | 6/1988 | Regalbuto et al. | 102/275.8 |
| 4,765,246 | A | * | 8/1988 | Carlsson et al. | 102/275.12 |
| 4,776,276 | A | | 10/1988 | Yunan | 102/275.5 |
| 4,836,109 | A | * | 6/1989 | Wesson et al. | 102/275.7 |
| 4,938,143 | A | | 7/1990 | Thomas et al. | 102/318 |
| 4,998,478 | A | * | 3/1991 | Beck | 102/275.12 X |
| 5,204,493 | A | | 4/1993 | Christmann et al. | 102/307 |
| 5,271,332 | A | | 12/1993 | Guirguis | 102/476 |
| 5,565,644 | A | | 10/1996 | Chawla | 102/307 |
| 5,705,768 | A | | 1/1998 | Ey | 102/307 |
| 5,756,925 | A | | 5/1998 | Frank et al. | 102/202.7 |
| 5,831,204 | A | * | 11/1998 | Lubben et al. | 102/275.4 |
| 5,889,228 | A | | 3/1999 | Ewick et al. | 102/275.5 |
| 5,959,237 | A | | 9/1999 | Clement | 102/317 |
| 6,167,811 | B1 | | 1/2001 | Walters | 102/476 |
| 6,182,573 | B1 | * | 2/2001 | Richards et al. | 102/275.12 |
| 6,227,095 | B1 | * | 5/2001 | Woodall et al. | 102/318 X |

OTHER PUBLICATIONS

Kohler, Josef et al., *Explosives* pp. 33–35, 70–73, 92–93, 264–265, 270–273, 370–373 (1993).

Woodhead, D. W., "Velocity of Detonation of a Tubular Charge of Explosive," 160 NATURE 644 (Nov. 8, 1947).

Woodhead, D. W., "Advance Detonation in a Tubular Charge of Explosive," 163 NATURE 1756–7 (Jun. 20, 1959).

* cited by examiner

EXPLOSIVE DEVICE WITH ASSEMBLED SEGMENTS AND RELATED METHODS

RELATED APPLICATIONS

This patent application is a continuation-in-part patent application of U.S. patent application Ser. No. 08/521,930 that was filed on Aug. 31, 1995, and that issued as U.S. Pat. No. 5,959,237 on Sep. 28, 1999.

BACKGROUND

1. The Field of the Invention

This invention relates to explosive devices employed to detonate explosive materials of the types used in mining and construction, and to explosive devices used in seismic survey activity. The present invention has particular applicability to explosive devices made of cast explosive materials.

2. Background Art

A. Types of Explosive Devices

Typically, two components are involved in initiating the detonation of an explosive device.

The first of these components is stimulated directly from a control device in order to initiate the explosion. Such components include detonators and transmission lines, such as detonating cords, shock tubes, and electrically conductive wires. In the former, a highly explosive material is concentrated in the small package at the end of a cable that is capable of communicating an electrical or another type of stimulus to the detonator from the detonation control device. A detonating cord, by contrast, is a continuous thread of highly explosive material. Once a stimulus for detonation is applied at the output end of a detonating cord remote from the detonator, the detonating cord detonates along the length thereof in a progressive manner. Shock tubes function in a similar manner. Conductive wires, by contrast, convey electrical current to the explosive device, thereby initiating the detonations of the explosive material of the explosive device.

The use of detonators and transmission lines permits safe, remote initiation of the explosion of explosive devices, but neither is of itself capable of generating adequate energy to produce a shock front suitable to the needs of mining, construction, or seismic survey activity. Therefore, a transmission line or a detonator is used to explode a larger explosive device that is generally made of a less sensitive explosive material than is the detonator or the detonating cord.

An explosive device thus functions to amplify the energy of a detonator, a shock tube, or a detonating cord into an explosion sizable enough to produce a shock wave front that effects useful work. In mining and construction activity, the work performed by the shock wave front is that of initiating the detonation of a relatively insensitive explosive material of large volume. In seismic survey activity, the work performed by the shock wave front is that of producing vibrations that travel through subsurface geological structures and are reflected from the interfaces between subsurface structures possessed of differing qualities. These reflected seismic shock wave fronts are detected remotely from the source of the seismic shock wave front and used in computer calculations to map the locations and extent of such subsurface interfaces between structures possessed of different qualities.

A typical configuration of the elements of a system that produces an explosive detonation used in mining and construction is shown in FIG. 1. There, a borehole 10 has been drilled to a predetermined depth into a subsurface geological formation 11, which is to be shattered by explosives, possibly to prepare it for subsequent mechanical removal. An explosive device, in this case an explosive booster device 12, has been lowered to the bottom 13 of borehole 10. By way of illustration, operably engaged within explosive booster device 12 is a detonator 14 at the output end of a transmission line, in this case a detonating tube 15. Detonating tube 15 leads to a selectively operable control device, in this case a detonating tube trigger box 16. With explosive booster device 12 and detonator 14 thus disposed at the bottom 13 of borehole 10, a suitable low energy, high volume explosive material 17 has been poured into borehole 10 contacting explosive booster device 12.

Trigger box 16 is a pedal operated device that ignites a quantity of gun powder comparable in amount to that in a shotgun shell. The gun powder is disposed at the output end of detonating tube 15 remote from detonator 14. The firing of the quantity of gunpowder in trigger box 16 commences a slow detonation that travels along detonating tube 15 from trigger box 16 to detonator 14. The arrival of this traveling detonation along detonating tube 15 at detonator 14 sets off detonator 14, which in turn leads to the explosion of explosive booster device 12. This explosion produces a shock wave front that travels radially outwardly from explosive booster device 12. A portion of that shock wave front, which is referred to as a detonating wave front, passes through high volume explosive material 17, causing the detonation thereof. The entire process is completed within a few milliseconds. In order to contain and drive laterally into geological formation 11 the explosive force of high volume explosive material 17, the open end 18 of borehole 10 has been stemmed with backfill 19.

Geological formation 11 in which borehole 10 was drilled and equipped for explosive detonation as shown in FIG. 1 could be located at the surface of the ground, at the bottom of a mining pit, or underground at the working face of a mine. Typically, an array of boreholes, such as borehole 10, is prepared together in a rock formation before any detonation occurs. Then, the columns of blasting agent in the borehole matrix are detonated simultaneously or in a nearly simultaneous pattern progression of detonations according to the specific consequences sought. The depth of borehole 10 and the height of the column of the high volume explosive material 17 placed therein are dictated by the nature of geological formation 11, as well as by the objective of the blasting exercise.

A typical configuration of the elements of a system that produces an explosive detonation used in seismic survey operations is shown in FIG. 2. There, a borehole 10 has been drilled a predetermined depth into a subsurface geological formation 11, through which a shock wave front is to be propagated for seismic survey purposes. The shock wave front is reflected off of the interfaces between subsurface structures of differing quality in geological formation 11. The reflected shock waves are then measured at an array of seismic detectors. The data from the seismic detectors for a number of shock wave fronts from different explosions is then processed to produce a three-dimensional map of the subsurface structures in geological formation 11.

An explosive device taking the form of explosive seismic device 20 has been lowered to the bottom 13 of borehole 10. Operably engaged within explosive seismic device 20 is a detonator 14 that communicates with a detonation control box 22 by way of a transmission line taking the form of an electrically conductive wire 21.

Detonation control box 22 is a hand-operated plunger device that generates an electrical signal that travels along wire 21 from detonation control box 22 to detonator 14. The arrival of this electrical signal at detonator 14 sets off the highly energetic explosive material of detonator 14. The energy from detonator 14 in turn causes the explosion of explosive seismic device 20.

The explosion of explosive seismic device 20 produces a shock wave front that travels radially outward from explosive seismic device 20, passing through geological formation 11 and being reflected off of subsurface structures therein possessed of differing qualities. The entire process, from activation of detonation control box 22 to the measurement of reflected shock waves at the seismic detectors, is completed in a few milliseconds. To contain the explosive force of explosive seismic device 20 and to drive the resulting shock wave front laterally into geological formation 11, borehole 10 has been stemmed with backfill 19. Although borehole 10 is illustrated in FIG. 2 as being completely stemmed with backfill 19, boreholes in seismic operations can also be partially stemmed with backfill.

FIG. 3 illustrates a typical configuration of the elements of a system that produces an explosive detonation used to create a seismic shock wave front from above the ground surface of a geological formation 11. An explosive seismic device 23 has been secured with a seismic survey rod 24 above the surface of the geological formation 11 to be seismically surveyed. By way of illustration, operably coupled between explosive seismic device 23 and a remotely operated detonation box 26 is a transmission line, in this case a detonating cord 25.

The remotely operated detonation box 26 illustrated in FIG. 3 is selectively controlled by radio frequency signals Rf emitted by a remote control 27. Upon receiving radio frequency signals Rf, an electric cap within detonation box 26 introduces an electrical current into a wire 21 extending a distance from detonation box 26, which in turn initiate explosion of a detonator 14 external of detonation box. Detonator 14 causes detonating cord 25 to detonate. The detonation travels along detonating cord 25 to explosive seismic device 23, thus effecting the detonation of the explosive material of explosive seismic device 23. As the explosive material of explosive seismic device 23 detonates, seismic survey rod 24 is driven into geological formation 11, transmitting a shock wave front generated by explosive seismic device 23 into geological formation 11. The shock wave front is then reflected by subsurface structures of differing quality in geological formation 11. The reflected shock waves are detected at an array of seismic detectors. The entire process, from sending radio frequency signals Rf from remote control 27 to the detection of reflected shock waves at the seismic detectors, is completed in a few milliseconds. Data generated by the array of seismic detectors upon measuring reflected shock waves from a number of explosions is used to generate a three-dimensional map of geological formation 11.

B. The Mechanics of Detonation

The manner in which a transmission line, such as detonating tube 15, or detonator 14 detonates an explosive device, such as explosive booster device 12, is illustrated in the sequence of FIGS. 4A–4E.

In FIG. 4A, a detonating impulse I travels along detonating tube 15 to detonator 14, exploding detonator 14. As detonator 14 explodes, a detonating wave front 28, shown in FIG. 4B, is created that travels radially outwardly through the explosive material of explosive booster device 12 from the position at which detonator 14 was located. As detonating wave front 28 passes through explosive material, the explosive material detonates.

FIG. 4B illustrates the manner in which detonating wave front 28 begins traveling through explosive booster device 12. Detonating wave front 28 continues traveling in a substantially radial fashion through explosive booster device 12, as shown in FIG. 4C, until detonating wave front 28 reaches the exterior of explosive booster device 12.

As depicted in FIG. 4D, when a portion of detonating wave front 28 has detonated all of the explosive material of explosive booster device 12 in the path of that portion of detonating wave front 28, that portion of detonating wave front 28 becomes a shock wave front 29.

Within a matter of milliseconds, all of the explosive material of explosive booster device 12 has been detonated as depicted in FIG. 4E. The shock wave front 29 from explosive booster device 12 effects the explosion of the high volume explosive material 17 depicted in FIG. 1 or creates seismic waves in the geological formation 11 illustrated in FIGS. 2 and 3.

C. Manufacture of Conventional Explosive Devices

Conventionally, explosive devices of the types described above are manufactured in open-topped molds having cavities of the desired configuration, such as prismatic, cylindrical, or frustoconical. Interior features of the explosive devices, such as passageways therethrough, are formed by solid inserts positioned in the open-topped mold. After solid inserts have been disposed in the open-topped mold, molten explosive material is poured manually or automatically into the cavity of the mold. As the explosive material cools, the explosive material solidifies to form a cast explosive device. The solid inserts are then removed from the explosive device to open up the passageways formed thereby. Thus, conventional methods for manufacturing explosive devices can be labor intensive and time consuming.

When cardboard molds are used, the cardboard molds may remain on the explosive devices in use thereof or can be removed from the explosive devices. Reusable molds can only be employed in the manufacture of explosive devices having prismatic configurations or configurations with transverse cross sections that taper progressively along the length of these explosive devices. Explosive devices that have transverse cross sections that do not taper progressively along the length thereof cannot be removed from an open-topped mold without destroying the mold. Moreover, explosive devices with internal cavities having complex shapes cannot be easily formed by conventional explosive material molding techniques.

No practical methods exist for manufacturing segmented explosive boosters, particularly explosive boosters that receive a detonator or a portion of a transmission line.

D. Explosive Devices Contrasted with Solid Rocket Motors

Pentolite is explosive material that is commonly used in explosive devices such as explosive booster devices and explosive seismic devices. A shock wave front will travel through Pentolite at a rate of about 7,400 to 7,600 meters per second, detonating the Pentolite at a rate of about 7,400 to 7,600 meters per second. Other explosive materials also detonate to cause an explosion.

Solid rocket motors are not configured to explode. Solid rocket motors are configured to burn at controlled rates. The burning of a rocket motor is not caused by a detonating wave front, but by igniting the propellant material of the solid rocket motor. After igniting the propellant material of a solid rocket motor, the propellant material simply burns at a predetermined rate until the propellant material is consumed. Thus, rocket motors do not detonate. The rate at which the materials of solid rocket motors burn is very slow relative to the rate at which explosive materials detonate.

Rockets are designed to transport cargo. Solid rocket motors are typically configured to burn evenly for an extended duration, generating large quantities of relatively low-velocity exhaust gases in the process. If the material of a rocket motor were to transition from a controlled burn to a state of detonation, the rocket motor would explode, destroying the rocket and the cargo to be carried thereby. Because of the uses for which rocket motors are designed and since solid rocket motors are configured to burn at controlled rates, rocket motors are different from explosive devices, such as the explosive devices illustrated in FIGS. 1–3. A rocket booster is most emphatically not an explosive booster.

SUMMARY OF THE INVENTION

It is thus a broad object of the present invention to increase the speed and efficiency with which explosive devices may be manufactured.

It is also an object of the present invention to permit the manufacture of explosive devices having configurations that cannot be readily manufactured by conventional processes.

It is a further object of the present invention to increase the velocity of detonation of explosive devices.

To achieve the foregoing objects, and in accordance with the invention as embodied and broadly described herein, segmented explosive devices, as well as systems and methods for manufacturing and using segmented explosive devices, are provided.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

In one form, an apparatus incorporating teachings of the present invention, which is capable of producing a shock wave front upon being exploded by a detonation signal generated by a selectively operable control device and communicated to the apparatus by a transmission line coupled between the control device and the apparatus, has an elongate explosive first charge segment and an elongate explosive second charge segment. First and second abutment surfaces are formed on the exterior surfaces of the first and second charge segments, respectively. The first charge segment has a cavity recessed in the first abutment surface thereof. The cavity is configured to receive the output end of the transmission line. The first abutment surface of the first charge segment is disposed against the second abutment surface of the second charge segment in an assembled relationship of the first and second charge segments. Assembly means secure the first and second charge segments in the assembled relationship thereof.

An example of the assembly means that is useful for securing the first and second explosive charge segments together in the assembled relationship thereof is an adhesive material disposed between the first and second abutment surfaces to secure the first charge segment to the second charge segment. Other assembly means may be disposed on an external surface of the explosive device to secure the first charge segment to the second charge segment in the assembled relationship thereof.

The first abutment surface can also include male-female mating means thereon. The male-female mating means are positioned to receive complimentarily configured and positioned female mating means and male mating means on the second abutment surface of the second charge segment. When the first and second charge segments are disposed in the assembled relationship thereof, the male-female mating means stabilize the disposition of the first charge segment and the second charge segment.

In one aspect of the present invention, the male mating means are nodules that protrude from one of the first and second abutment surfaces and the female mating means are recesses configured complimentarily to the nodules and positioned correspondingly to the nodules on the other of the abutment surfaces.

In another aspect of the present invention, the amount of time required to completely detonate an explosive device is decreased. As a shock wave front travels through voids in an explosive device, a plasma zone propagates ahead of the shock wave front. When the plasma zone impacts explosive material in the path thereof, plasma in the plasma zone causes the explosive material to detonate. Accordingly, the present invention includes a segmented explosive device having advancement means for permitting a plasma zone to progress internal of the explosive device and for initiating a secondary detonating wave front ahead of the initial detonating wave front. The advancement means thus facilitates advance detonation of the explosive device by providing one or more voids in which the plasma zone will travel and impact explosive material. The advancement means can be a non-linear channel recessed in the first abutment surface of the first charge segment. As a plasma travels through the non-linear channel in advance of a shock wave front, the plasma zone impacts explosive material of the explosive device at bends in the non-linear channel, initiating secondary detonation of the impacted explosive material and forming a secondary detonating wave front in the explosive material in the path of the plasma zone. Alternatively, the advancement means can be a cavity with a transverse cross section having a configuration or a size that changes along the length of the cavity. As a plasma zone travels through the cavity and impacts explosive material protruding into the channel in the path of the plasma zone, a secondary detonation is initiated and a secondary detonating wave front is created in the explosive material that protrudes into the path of the plasma zone.

According to yet another aspect of the invention, a charge segment can have two types of explosive materials. For example, the cavity recessed in the first abutment surface of the first charge segment is lined with a second explosive material that detonates with greater sensitivity than the first explosive material of the first charge segment.

BRIEF DESCRIPTION OF THE DRAWINGS

A more particular description of the invention briefly described above will be rendered by reference to a specific embodiment thereof which is illustrated in the appended drawings in order to illustrate and describe the manner in which the above-recited and other advantages and objects of the invention are obtained. Understanding that these drawings depict only a typical embodiment of the invention and are not therefore to be considered limiting of its scope, the invention will be described and explained with additional specificity and detail through the use of the accompanying drawings in which.

DETAILED DESCRIPTION OF THE ILLUSTRATED EMBODIMENTS

The present invention pertains to segmented explosive devices and to systems and methods for manufacturing segmented explosive devices.

FIGS. 5–41 depict embodiments of apparatus, systems, and methods embodying teachings of the present invention.

Figure 5:
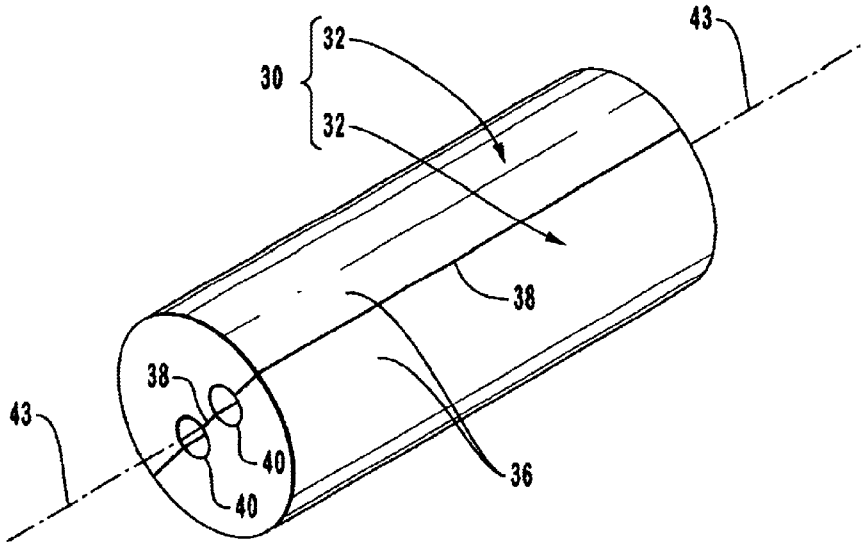
FIG. 5 is a perspective view of a first embodiment of a prismatic explosive device embodying teachings of the present invention.

A first embodiment of a prismatic segmented explosive device 30 according to the present invention is depicted in FIG. 5. Explosive device 30 includes first and second elongate, semicylindrical explosive charge segments 32. As illustrated, the configurations of the transverse cross sections of charge segments 32 taken along the lengths thereof are semicircles of unchanging size. First and second charge segments 32 are disposed in a predetermined assembled relationship. An interface 38 is formed between charge segments 32 in the predetermined assembled relationship thereof.

Although explosive device 30 is depicted in FIG. 5 as having a cylindrical shape, segmented explosive devices of other configurations, including, without limitation, cubical, rectangular block, spherical, conical, frustoconical, hourglass, ellipsoidal, and other shapes, are also within the scope of the present invention. The segmented explosive devices may also have one or more tapered surfaces.

While FIG. 5 illustrates an explosive device 30 that has an interface 38 along a longitudinal axis 43 thereof, interface 38 may, alternatively, be oriented parallel to a transverse cross section taken along the length of longitudinal axis 43.

Explosive device 30 also includes passageways 40 through the interior thereof. Two substantially identical passageways 40, although not readily apparent from FIG. 5 alone, extend through the interior of explosive device 30, intersecting interface 38. Passageways 40 need not, however, be positioned along interface 38. For example, passageways 40 may be contained completely within one charge segment 32 or formed partially in an exterior of explosive device 30, such as in the external surface 36 of one charge segment 32 or in adjacent regions of external surfaces 36 of two or more adjacent charge segments 32. Passageways 40 may also have other, non-cylindrical configurations, as well as transverse cross sections that have configurations or sizes that change along the lengths thereof. Moreover, although explosive device 30 is shown as having two passageways 40 extending through the interior thereof, it is to be understood that any suitable number or size of cavities 40 may be formed in or through explosive device 30. Passageways 40 are each configured to receive a detonator, such as a blasting cap, and the output end of a transmission line, such as a detonating cord, a detonating tube, or a wire coupled to the detonator.

Alternatively, since a detonator or the output end of a transmission line coupled to the detonator may be secured to the exterior of explosive device 30, passageways 40 need not extend entirely through explosive device 30.

Figure 6:
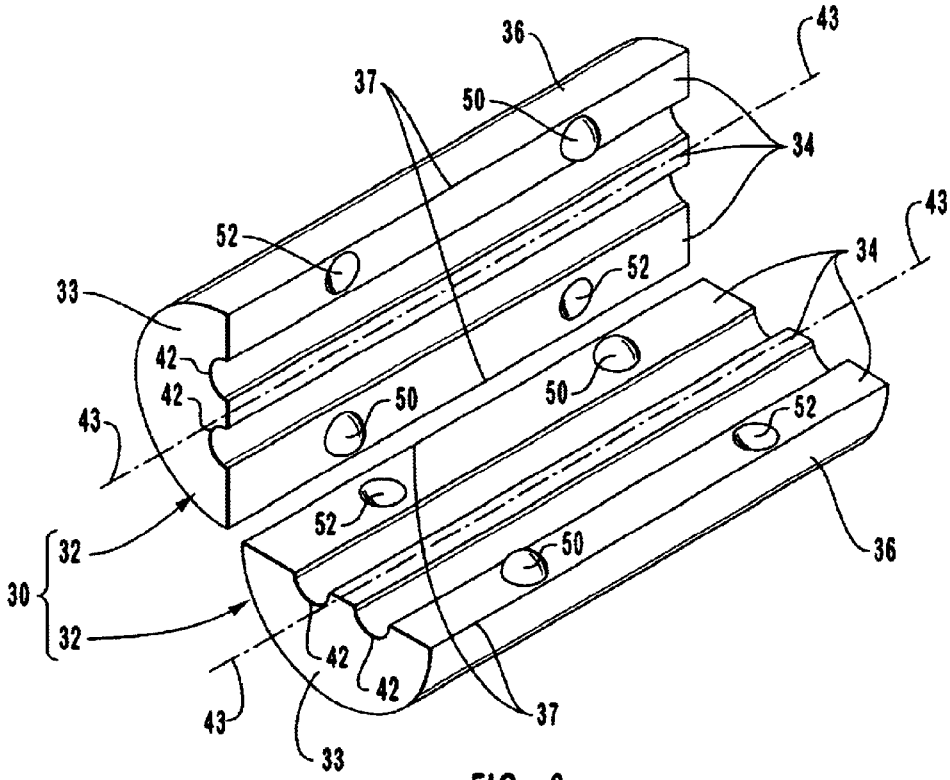
FIG. 6 is a perspective view of the constituent components of the explosive device of FIG. 5 in a disassembled condition.

FIG. 6 illustrates charge segments 32 of explosive device 30 in a disassembled relationship. Each charge segment 32 has two ends 33. Each charge segment 32 also has an abutment surface 34 on the diameter thereof and a semicylindrical external surface 36 on the circumference of charge segment 32. Abutment surface 34 and external surface 36 meet at two locations to form two straight edges 37. Although abutment surfaces 34 are illustrated in FIG. 6 as being planar and identically configured, it is not inconsistent with the teachings of the present invention as disclosed to configure explosive charge segments with non-congruent or non-planar, complimentarily configured abutment surfaces.

As depicted in FIG. 6, each charge segment 32 has two elongated, semicylindrical cavities 42 recessed into abutment surface 34 thereof. Cavities 42 traverse the full length of abutment surface 34, opening on each end 33 of charge segment 32. Cavities 42 are positioned parallel longitudinal axis 43, spaced equal distances from longitudinal axis 43 on opposite sides thereof. Thus, passageways 40, illustrated in FIG. 5, are formed by an opposed pair of cavities 42 in the assembled relationship of charge segments 32. As illustrated, the configurations and sizes of the transverse cross sections are unchanging along the full lengths of cavities 42.

According to another aspect of the present invention, charge segments, such as charge segments 32 illustrated in FIG. 6, include male-female mating means for facilitating and stabilizing the disposition of charge segments 32 in an assembled relationship thereof. As shown in FIG. 6 by way of example and not by way of limitation, charge segments 32 each have a pair of semispherical nodules 50 protruding from abutment surface 34 and a pair of semispherical recesses 52 formed in abutment surface 34. One nodule 50 is located on abutment surface 34 between each cavity 42 and edge 37 formed at the junction of abutment surface 34 and external surface 36 adjacent opposite ends 33 of charge segment 32. Recesses 52 are formed in abutment surface 34 between each cavity 42 and the adjacent edge 37, near an opposite end 33 of charge segment 32 as nodule 50 located adjacent to the same edge 37. Abutment surfaces 34 of charge segments 32 are congruent. Nodules 50 and recesses 52 are congruently positioned on abutment surfaces 34 of first and second charge segments 32 to facilitate alignment of first charge segment 32 with complementary recesses 52 and nodules 50 on abutment surface 34 of a second charge segment 32.

Alternative configurations of the male-female mating means include disc shapes, cylinders, cubes or other blocks, star shapes, pyramids, other shapes of triangular cross section, and cross shapes. Although nodules 50 and recesses 52 are depicted in FIG. 6 as being positioned in particular locations, nodules 50 and recesses 52 may be positioned at different locations on abutment surface 34. Charge segment 32 may also include a different number of nodules 50 and recesses 52 on abutment surface 34. Charge segments 32 need not have congruent abutment surfaces 34.

In disposing first and second charge segments 32 in the assembled relationship thereof in the manner shown in FIG. 5, first and second abutment surfaces 34 are aligned with and placed in contact with each other over the full extents thereof. As the first abutment surface 34 is brought into contact with the second abutment surface 34, nodules 50 of the first charge segment 32 and recesses 52 of the second charge segment 32 matingly engage each other. Nodules 50 of the second charge segment 32 and recesses 52 of the first charge segment 32 also matingly engage each other. Upon assembling first and second charge segments 32, explosive device 30 is formed.

Figure 7:
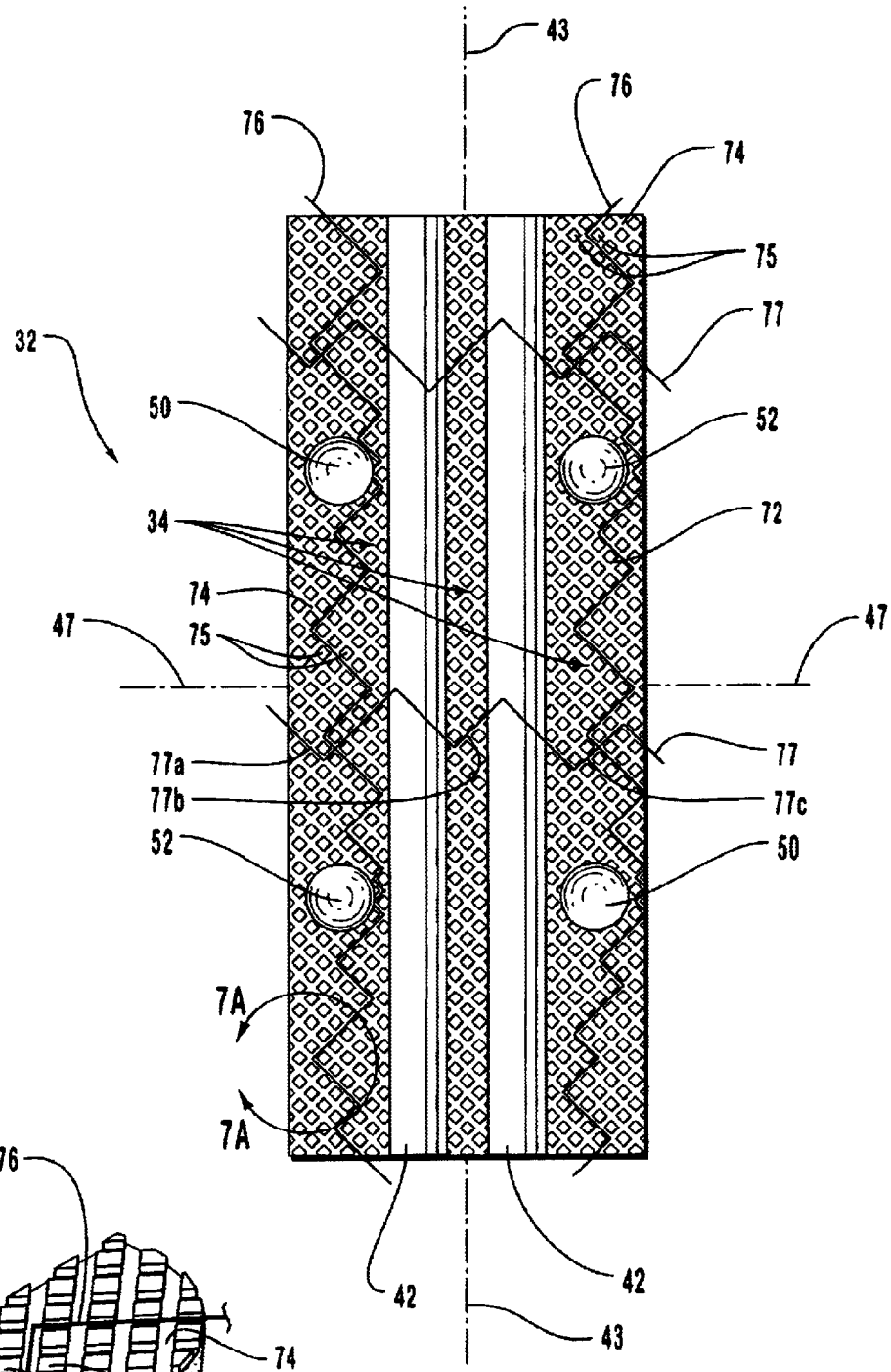
FIG. 7 is a plan view of a textured variation of the abutment surface of a constituent segment of a second embodiment of an explosive device embodying teachings of the present invention.

In another aspect of the invention, one or both abutment surfaces of a charge segment according to the present invention may have texturing thereon. An example of a texturing 72 on an abutment surface is shown in FIG. 7, which illustrates an abutment surface 34 having recessed areas 74 formed therein in a cross-hatched arrangement. Associations of continuous recessed areas 74 between raised areas 75 of abutment surface 34 form channels 76,77 in abutment surface 34. Channels 76,77 may traverse abutment surface 34 completely or partially and may open on a periphery of abutment surface 34. Some channels 76 may extend substantially parallel to a longitudinal axis 43 of explosive device 30. Other channels 77 may extend substantially parallel to a latitudinal axis 47 of explosive charge segment 32. Channels 77 may include segments 77*a*, 77*b*, 77*c* that communicate across cavities 42.

Figure 7A:
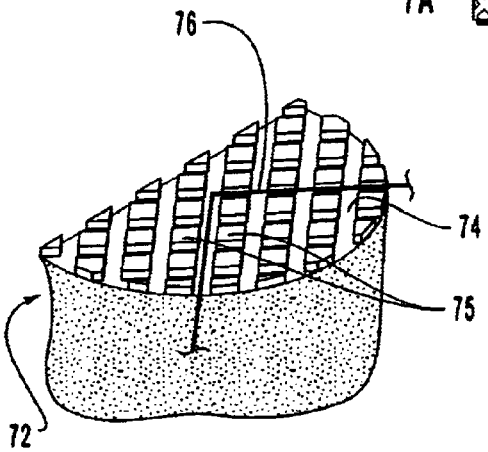
FIG. 7A is a close-up perspective view of the interface segment depicted in FIG. 7.

FIG. 7A illustrates the texturing 72 of abutment surface 34 in perspective. Texturing 72 has raised areas 75 between which recesses 74 are formed. A channel 76 is formed on abutment surface 34 by communicating recessed areas 74 located between raised areas 75 of the texturing 72 of abutment surface 34.

Texturing 72 or other irregularities or patterning of abutment surface 34 may form regions adjacent to or intersecting interface 38 where a first charge segment 32 does not contact a second charge segment 32 upon assembly therewith in the assembled relationship of charge segments 32. Accordingly, upon the disposition of two or more explosive charge segments 32 in an assembled relationship thereof, the texturing 72 of abutment surface 34 forms voids at interface 38 within the interior of explosive device 30.

Alternatively, the texturing of abutment surface 34 may be raised from abutment surface 34 rather than formed in abutment surface 34. For example, abutment surface 34 may include raised cross hatching or waffle type texturing. A first charge segment 32 having raised texturing on the abutment surface 34 thereof may be assembled with a second explosive charge segment 32 having a substantially planar abutment surface 34, an abutment surface 34 having raised texturing thereon, or an abutment surface 34 with recessed texturing formed therein. When a first, positive explosive charge segment 32 having raised texturing on abutment surface 34 is assembled with a second, negative charge segment 32 having texturing recessed in the abutment surface 34 thereof, the raised texturing on the first abutment surface 34 can be matingly received by the texturing recessed in the second abutment surface 34.

Another aspect of the present invention is illustrated in FIGS. 8–11, which show prismatic explosive devices having subsectioned charge segments.

Figure 8:
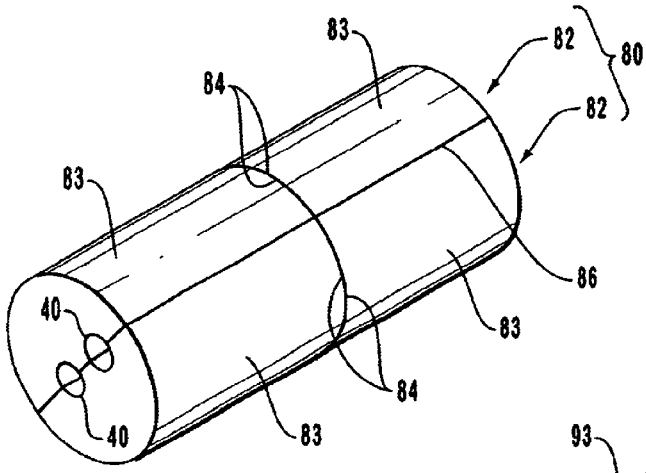
FIG. 8 is a perspective view of a first embodiment of a subsectioned prismatic explosive device embodying teachings of the present invention.

FIG. 8 depicts a first embodiment of a subsectioned prismatic explosive device 80 that includes two charge segments 82, each having two members 83 of substantially the same configuration and length. Members 83 each have a length equal to about half of the total length of charge segments 82 and of explosive device 80. Each member 83 has a semicylindrical shape. One end of each member 83 forms an adjoinment surface 84. When adjoinment surfaces 84 of adjacent members 83 are in contact, the adjacent members 83 form a charge segment 82 and the diameters of the adjacent members 83 form an abutment surface 86 of charge segment 82.

Figure 9:
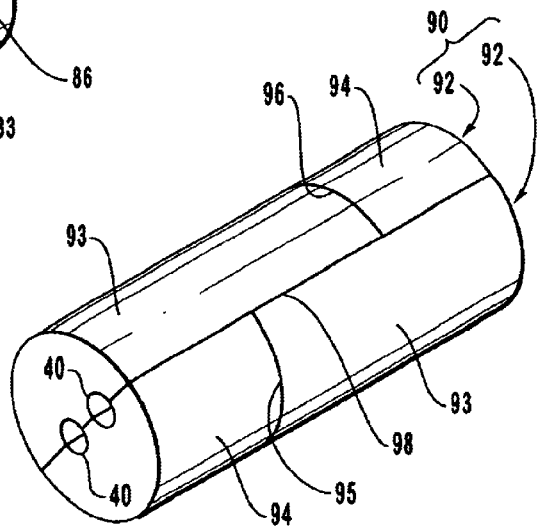
FIG. 9 is a perspective view of a second embodiment of a subsectioned prismatic explosive device embodying teachings of the present invention.

A second embodiment of a subsectioned prismatic explosive device 90 is illustrated in FIG. 9. Explosive device 90 has two semicylindrical charge segments 92. Each charge segment 92 has a semicylindrical first member 93 and a semicylindrical second member 94. Second members 94 have transverse cross sections taken along the lengths thereof with substantially the same size as the transverse cross sections of first members 94. The length of each first member 93 is, however, greater than the length of each second member 94. One end of each first member 93 forms a first adjoinment surface 95. One end of each second member 94 forms a second adjoinment surface 96. Upon disposal of a first adjoinment surface 95 of a first member 93 in contact over the full extent thereof with a second adjoinment surface 96 of a second member 94, first member 93 and second member 94 form a charge segment 92. When assembled, the diameters of first member 93 and second member 94 form an abutment surface 98. Charge segments 92 are assembled with abutment surfaces 98 in contact over the full extent thereof to form a cylindrical explosive device 90.

Figure 10:
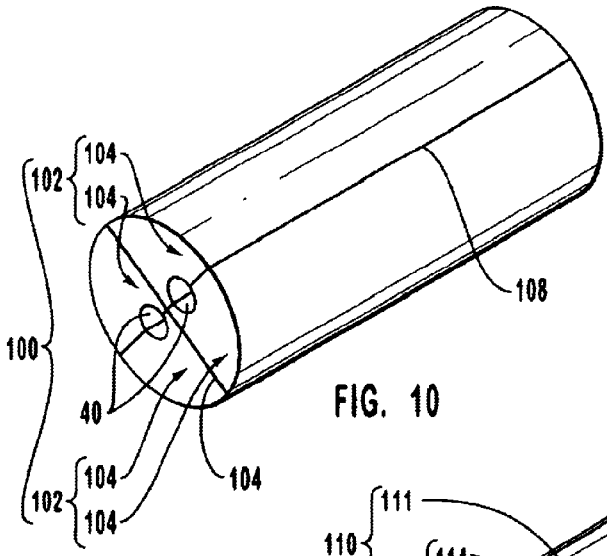
FIG. 10 is a perspective view of a third embodiment of a subsectioned prismatic explosive device embodying teachings of the present invention.

The explosive device 100 depicted in FIG. 10 is a third embodiment of a subsectioned prismatic explosive device that has two elongate, semicylindrical charge segments 102 of substantially the same size. Each charge segment 102 has two members 104 of the same length. The configuration of each member 104 is a quarter of a cylinder, with two diameters and a circumference. A first diameter of each member 104 forms an adjoinment surface 106. As adjoinment surfaces 106 of two members 104 are brought into contact over the full extent thereof, members 104 form a charge segment 102. When members 104 are assembled to form charge segment 102, the second diameters of members 104 are located in the same plane and form an abutment surface 108 of charge segment 102. Charge segments 102 are assembled with abutment surfaces 108 in contact over the full extent thereof to form explosive device 100.

Figure 11:
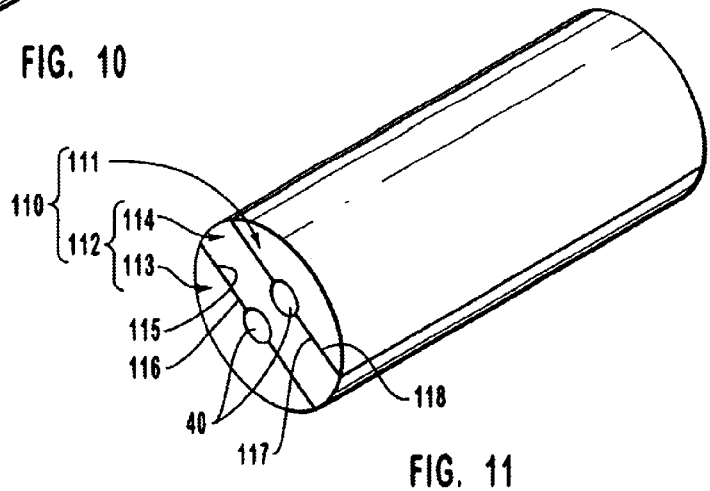
FIG. 11 is a perspective view of a fourth embodiment of a subsectioned prismatic explosive embodying teachings of the present invention.

FIG. 11 depicts a fourth embodiment of a subsectioned prismatic explosive device 110 that includes a first charge segment 111 and a second charge segment 112 with an outer member 113 and an inner member 114. First charge segment 111 has a first abutment surface 117 formed on a portion of the exterior thereof. A first adjoinment surface 115 is formed on a portion of the exterior of outer member 113. A second adjoinment surface 116 is formed on a portion of the exterior of inner member 114. Another portion of the exterior of inner member 114 forms a second abutment surface 118. As first adjoinment surface 115 and second adjoinment surface 116 are brought into contact over the full extents thereof, second charge segment 114 is formed. When first abutment surface 117 and second abutment surface 118 are brought into contact over the full extents thereof, explosive device 110 is formed.

Alternatively, any other suitable number of explosive charge segments having different lengths or different cross-sectional shapes may be assembled to form a segmented explosive device according to the present invention.

Due to the configurations of the explosive devices described herein, including the explosive devices illustrated in FIGS. 5–11 and the explosive devices described hereinafter, explosive devices incorporated teachings of the present invention detonate differently than do explosive devices having conventional configurations. The rate at which a detonating wave front travels through explosive material and, thus, the rate at which the explosive material of an explosive device yields up the energy therein by detonating is referred to as the velocity of detonation (hereinafter "the VOD") for that explosive device. The VOD of a segmented explosive device 30 illustrated in FIG. 5 comprised of Pentolite is about 39,000 feet per second. In contrast, the VOD of a similarly configured, single-piece, conventional explosive device comprised of Pentolite is from about 27,000 to about 30,000 feet per second. Thus, the VOD of segmented explosive device 30 is about 30–33% greater than the VOD of a similarly configured, single-piece conventional explosive device manufactured from the same explosive material. The VOD of each of the segmented explosive devices illustrated in FIGS. 5–11 is greater than the VOD of a comparable, single-piece explosive device having substantially the same size and manufactured from the same type of explosive material.

The VOD of an explosive device incorporating teachings of the present invention may be tailored between the VOD of a conventionally configured explosive device and a maximum VOD that may be obtained by employing teachings of the present invention and by using a particular explosive material. While the VOD associated with conventional explosive devices may suffice for many applications, explosive devices having higher velocities of detonation release energy faster, with greater impact, and with a crisper shock wave front. Ultimately, the same amount of energy is released from the explosive material of a conventionally configured explosive device made with the same volume of explosive material; however, explosive devices incorporating teachings of the present invention release the energy faster. Accordingly, an explosive device incorporating teachings of the present invention may be used to perform the same function with substantially the same result as a larger, conventionally configured explosive device.

Figure 12:
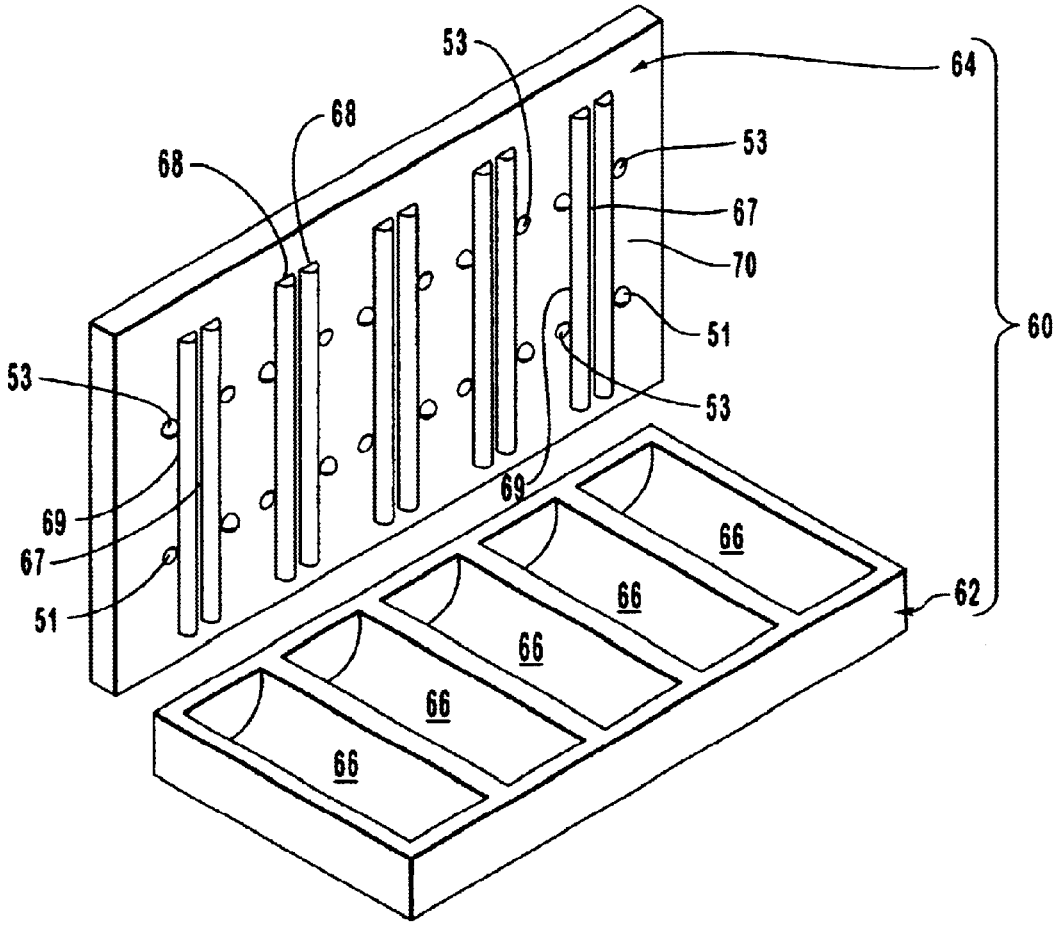
FIG. 12 is a perspective disassembled view of upper and lower mold casings used to manufacture constituent segments of explosive devices of the types as illustrated in FIGS. 5–11.

FIG. 12 illustrates a mold 60 that may be used to cast the explosive charge segments 32 shown in FIG. 6. Mold 60 includes a first mold half 62 and a second mold half 64. Second mold half 64 is shown in FIG. 12 relative to first mold half 62 in a disassembled condition of mold 60. First mold half 62 and second mold half 64 are configured to be assembled in a manner that effects the formation of charge segments 32.

FIG. 12 depicts first mold half 62, which includes elongate, semicylindrical cavities 66 therein. The radius of each cavity 66 is approximately equal to the radius of the desired explosive device 30 such as that shown in FIG. 5 to be formed in cavity 66. Although FIG. 12 illustrates a first mold half 62 with an elongate, semicylindrical mold cavity 66, mold cavity 66 may be configured with any other shape required to impart a charge segment 32 formed therein and, therefore, an explosive device 30 with a desired configuration. The surfaces of mold cavities 66 of first mold half 62, shown in FIG. 12, may similarly include indicia, such as designs, logos, product identifications, or labels, a mirror image of which will be formed in external surface 36 of charge segment 32 and displayed on the exterior of explosive device 30. First mold half 62 may be formed from any suitable mold material, such as steel, aluminum, or a fiber-reinforced composite. Alternatively, first mold half 62 can be formed from a flexible mold material, including, without limitation, a flexible material such as silicone, a plastic material such as a polyethylene or a polypropylene, or a composite material.

Second mold half 64 has a contact surface 70 with elongate, semicylindrical protrusions 68 thereon. Protrusions 68 are grouped in sets of two, each set of protrusions 68 corresponding to a mold cavity 66 of the first mold half 62 shown in FIG. 12. Each protrusion 68 has an inside edge 67 and an outside edge 69 opposite inside edge 67. The inside edges 67 of the protrusions 68 of each set are adjacent to each other.

Contact surface 70 of second mold half 64 also includes recesses 51 formed therein and nodules 53 protruding therefrom. Recesses 51 and nodules 53 are semispherical in shape. One recess 51 and one nodule 53 are positioned laterally adjacent outside edge 69 of each protrusion 68. The nodules 50 and recesses 52 of each charge segment 32 shown in FIG. 6 are formed by recesses 51 and nodules 53, respectively.

Contact surface 70 of second mold half 64 may also have thereon texturing with a hatch mark design or another type of texturing. A textured contact surface 70 will create corresponding texturing 72 such as that illustrated in FIGS. 7 and 7A in abutment surface 34 of charge segment 32 formed by mold 60.

Second mold half 64 may be formed from any suitable mold material, such as steel, aluminum, or a fiber-reinforced composite or from a flexible mold material, including, without limitation, a rubber material such as silicone, a plastic material such as a polyethylene or a polypropylene, or a composite material.

The segmented explosive devices 80, 90, 100, 110 depicted in FIGS. 8–11, respectively, may also be manufactured from a mold similar to mold 60 depicted in FIG. 12. Mold inserts may be employed to separate mold cavities 66 and to thereby provide the additional segmentation of segmented explosive devices 80, 90, 100, and 110. Alternatively, charge segments 32 may be sawed or otherwise cut to provide the additional segmentation of explosive devices 80, 90, 100, and 110.

Outer member 113 of explosive device 110 illustrated in FIG. 11 may be cast in a mold having a cavity of a shape complementary to outer member 113. Inner member 114 of explosive device 110 may be cast in another mold having a cavity of a shape complementary to the shape of inner member 114.

Although first mold half 62 is illustrated in FIG. 12 as having five mold cavities 66 and second mold half 64 is illustrated in FIG. 12 as having five sets of protrusions 68, a mold with only one mold cavity may also be employed in manufacturing a charge segment 32. Molds with other numbers or arrangements of mold cavities 66 may also be used to manufacture charge segments 32.

As an example of the use of mold 60 to manufacture a charge segment 32 such as that shown in FIGS. 5–7, a quantity of an explosive material, such as Pentolite or Cyclotol, is disposed in each mold cavity 66 of the first mold half 62 illustrated in FIG. 12. The second mold half 64 is aligned and assembled with first mold half 62 in the manner illustrated in FIG. 12 so that contact surface 70, each set of protrusions 68, recesses 51, and nodules 53 each contact the explosive material within a corresponding mold cavity 66 of first mold half 62.

Upon solidification, the explosive material within each mold cavity 66 is formed into the shape of a charge segment 32, such as that illustrated in FIGS. 5–7. Accordingly, external surface 36 of charge segment 32 has a shape complementary to the shape of the surface of mold cavity 66 of first mold half 62. Abutment surface 34 of charge segment 32 is configured complementarily to contact surface 70 of second mold half 64. Thus, each abutment surface 34 has two cavities 42 that are configured correspondingly to protrusions 68 on contact surface 70, nodules 50 that are configured correspondingly to recesses 51 in contact surface 70, recesses 52 that are configured correspondingly to nodules 53 on contact surface 70, and texturing 72 that corresponds to the texturing of contact surface 70. Once the explosive material disposed within each mold cavity 66 of first mold half 62 has 5 sufficiently solidified, the formed explosive charge segment 32 may be removed from mold cavity 66.

Although FIG. 12 illustrates a mold 60 having a first mold half 62 and a second mold half 34, other types of molds, such as a single, flexible mold, may also be used to manufacture explosive charge segment 32.

Figure 13:
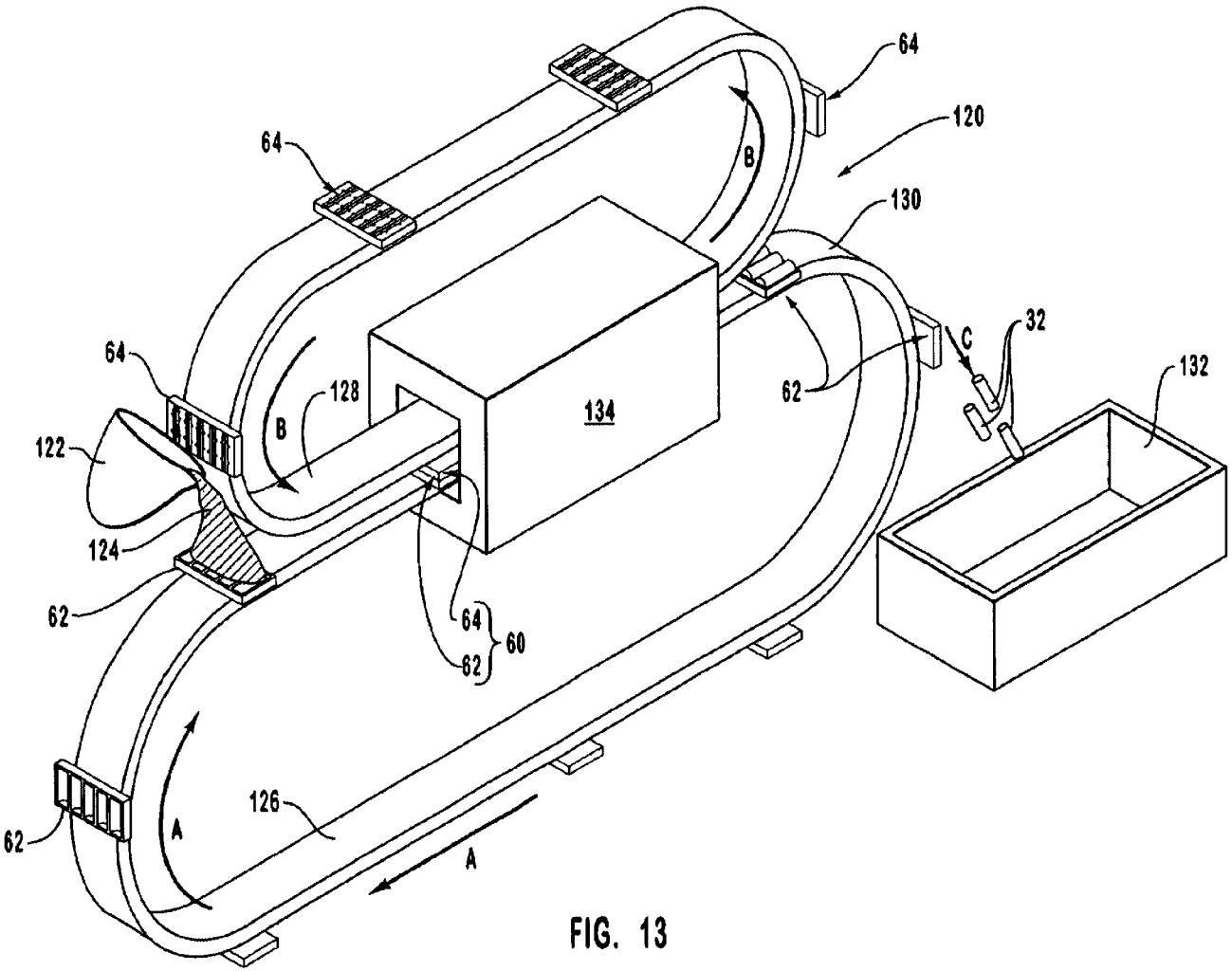
FIG. 13 is a schematic perspective view of a manufacturing method employing the mold halves of FIG. 12 to produce constituent segments of the explosive devices illustrated in FIGS. 5–11.

FIG. 13 illustrates an exemplary embodiment of the manufacturing method, in which a mold apparatus 120 having a first conveyor 126 which carries first mold halves 62 and a second conveyor 128 which carries second mold halves 64 is employed to manufacture explosive charge segments 32. Mold apparatus 120 includes a dispenser 122 for storing and dispensing explosive material 124 into cavities 66 of a first mold half 62 as a first mold half 62 is positioned beneath dispenser 122 by first conveyor 126. Although first mold halves 62 are illustrated in FIG. 13 as being spaced apart from one another, first mold halves 62 may be disposed directly adjacent one another on first conveyor 126. Second mold halves 64 may also be disposed directly adjacent one another along second conveyor 128, rather than spaced apart from one another as illustrated in FIG. 13.

First conveyor 126 and second conveyor 128 transport first mold halves 62 and second mold halves 64 in such a manner that, after explosive material 124 has been disposed in cavities 66, a first mold half 62 is assembled with a corresponding second mold half 64 to form an explosive charge segment 32 from explosive material 124.

Mold apparatus 120 may include a cooling chamber 134, through which assembled first mold halves 62 and second mold halves 64 are passed to expedite the solidification of explosive material 124 within cavities 66. Alternatively, mold apparatus 120 may be contained within a larger refrigeration chamber to facilitate solidification of explosive material 124.

When the explosive material 124 within each cavity 66 has adequately solidified or otherwise been formed into an explosive charge segment 32, second mold half 64 and first mold half 62 are disengaged and explosive charge segments 32 are removed from cavities 66 of first mold half 62. Explosive charge segments 32 may be removed from cavities 66 as first mold half 62 is rotated to a non-horizontal orientation, such as when first mold half 62 is moved across an end loop 130 of first conveyor 126. First mold half 62 may deform when moved across end loop 130, thereby facilitating the removal of explosive charge segments 32 from cavities 66 of first mold half 62.

Explosive charge segments 32 are disposed in the direction of arrow C into a receiving container 132, transferred to another conveyor assembly, or otherwise collected. Depending on the material of molds 60 and upon the explosive material, first mold half 62 and second mold half 64 may need to be rinsed or otherwise cleaned and lubricated prior to being employed to manufacture one or more other explosive charge segments 32.

Figure 3:
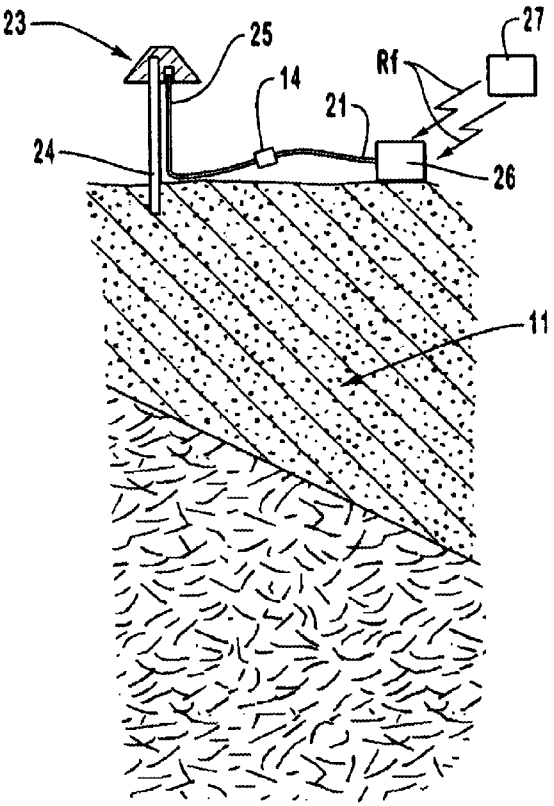
FIG. 3 (PRIOR ART)
FIG. 3 is a cross sectional diagram of typical components used to create a seismic survey shock front from above the surface of the ground.
Figure 2:
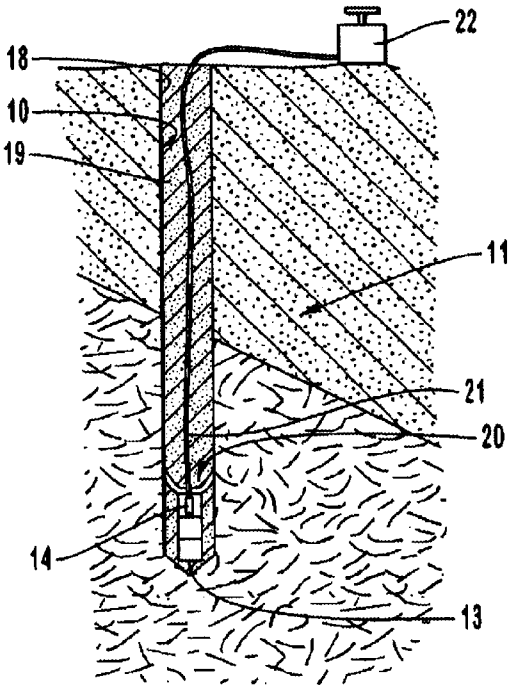
FIG. 2 (PRIOR ART)
FIG. 2 is a cross sectional diagram illustrating the typical components used to create a subsurface seismic survey shock front from a borehole.
Figure 1:
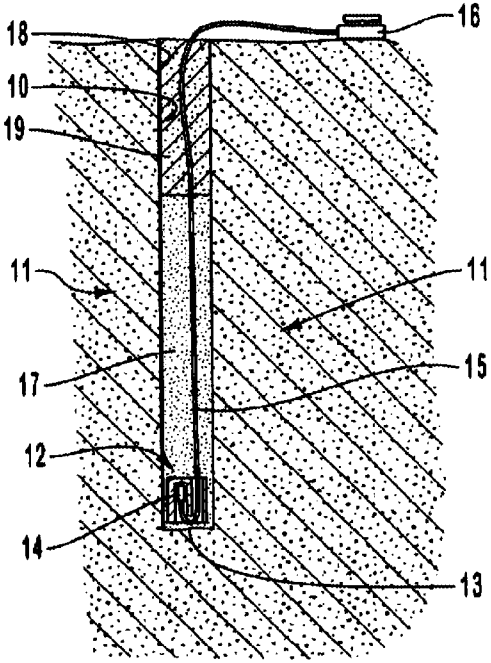
FIG. 1 (PRIOR ART)
FIG. 1 is a cross-sectional diagram of typical components used to detonate an explosion in a subsurface borehole to prepare a portion of the formation for removal for mining or construction.
Figures 4A, 4B, 4C, 4D, 4E:
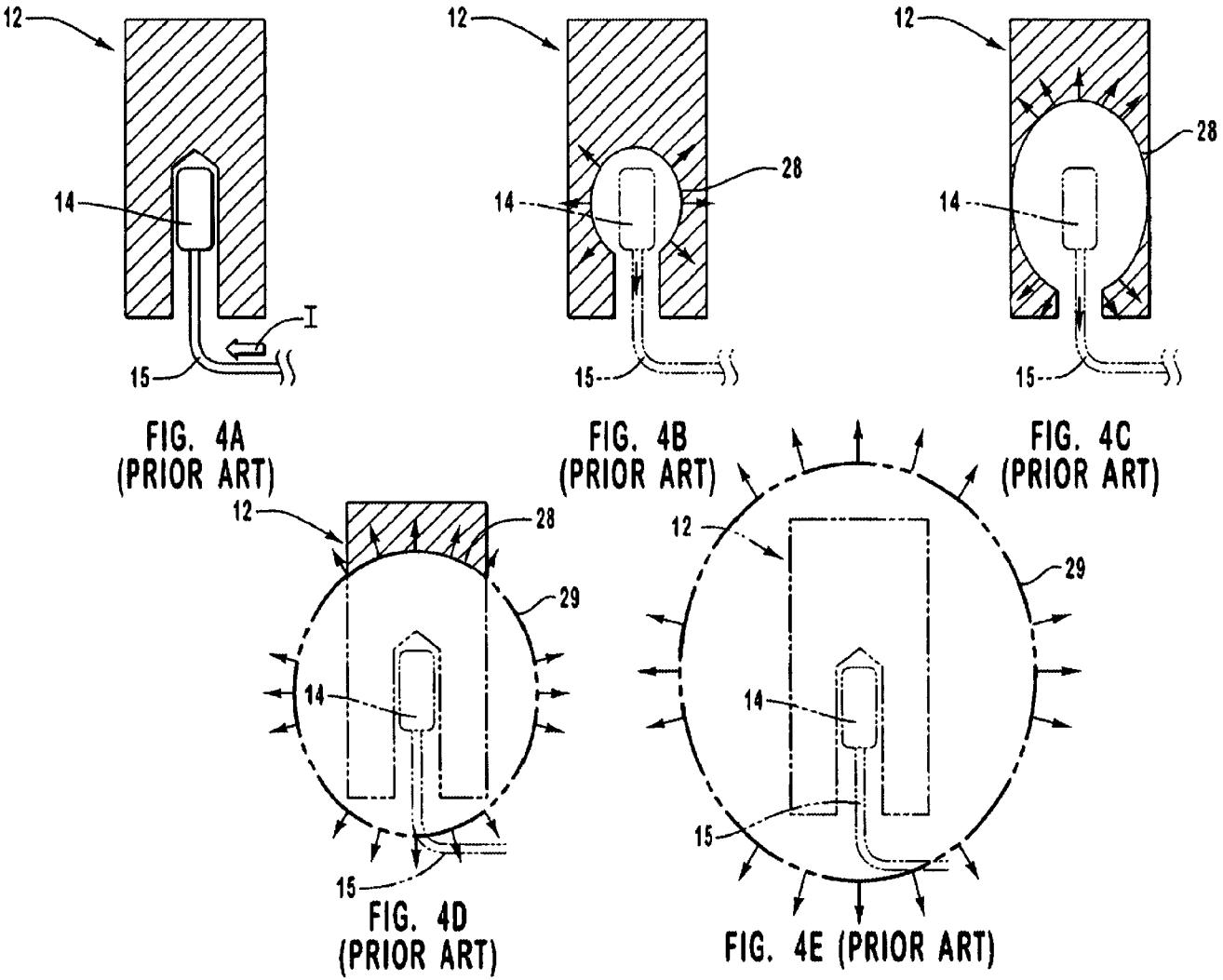
FIG. 4A (PRIOR ART)
FIG. 4B (PRIOR ART)
FIG. 4C (PRIOR ART)
FIG. 4D (PRIOR ART)
FIG. 4E (PRIOR ART)
FIGS. 4A–4E are a series of diagrams illustrating the initiation and propagation of a detonating wave front in an explosive booster device, and the corresponding development and generation of a shock front exterior of the device as a result of the explosion thereof.

By the manufacturing method illustrated in FIG. 13, when a mold of the type illustrated in FIG. 12, which includes a first mold half 62 having five cavities 66, is employed along with first conveyer 126 and second conveyor 128 at a speed of about one inch per second, about ten eight-ounce explosive charge segments 32 and, therefore, about five sixteen-ounce segmented explosive devices 30 of the type depicted in FIG. 1 may be manufactured every eight seconds. Thus, about 54,000 segmented explosive devices 30 can be manufactured in 24 hours. This number of segmented explosive devices 30 is about twenty-five percent greater than the number of sixteen-ounce segmented explosive devices 30 that can be manually cast by twelve people over a twenty-four hour period without requiring such a significant amount of human labor.

Explosive charge segments 32 are disposed in an assembled relationship in the manner illustrated in FIG. 5 to form an explosive device 30. Corresponding opposed nodules 50 and recesses 52, depicted in FIG. 6, matingly engage each other to facilitate alignment of first and second charge segments 32 in the predetermined assembled relationship. Such mating of nodules 50 and recesses 52 is not necessary, however, particularly when charge segments 32 are secured to one another.

According to another aspect of the present invention, abutment surfaces, such as abutment surfaces 34 of charge segment 32, include assembly means for securing charge segments in an assembled relationship. Assembly means are illustrated, by way of example and not by way of limitation, in FIGS. 14–18.

Figure 14:
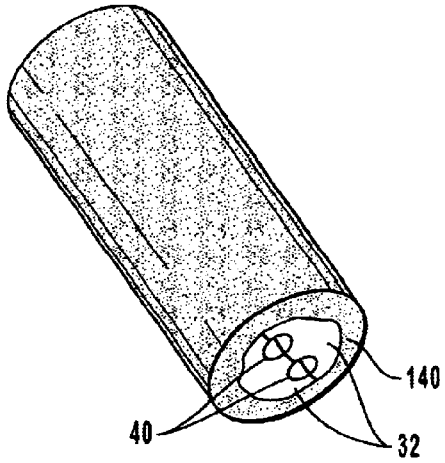
FIG. 14 is a perspective view of an explosive device of the type illustrated in FIGS. 5–7A, wherein the charge segments are secured in an assembled relationship using a first approach.

FIG. 14 depicts a first approach to performing the function of assembly means. As illustrated, a shrink wrap 140 covers the circumferences and partially covers the ends of both charge segments 32.

Figure 15:
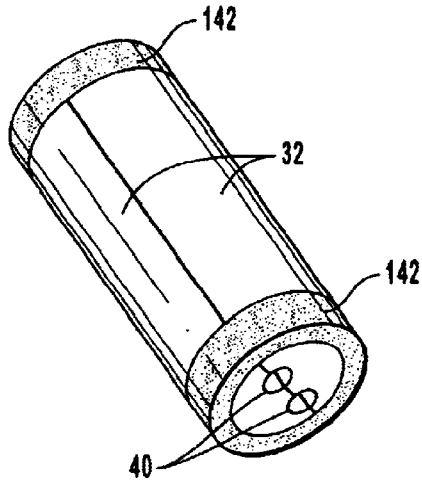
FIG. 15 is a perspective view of an explosive device of the type illustrated in FIGS. 5–7A, wherein the charge segments are secured in an assembled relationship using a second approach.

FIG. 15 illustrates explosive charge segments 32 being secured together by a second approach to performing the function of assembly means. As shown, end caps 142 cover the ends of charge segments 32. End caps 142 may be formed from any suitable material, such as a rubber, a plastic, cardboard or paper, a metal, or an explosive material.

Figure 16:
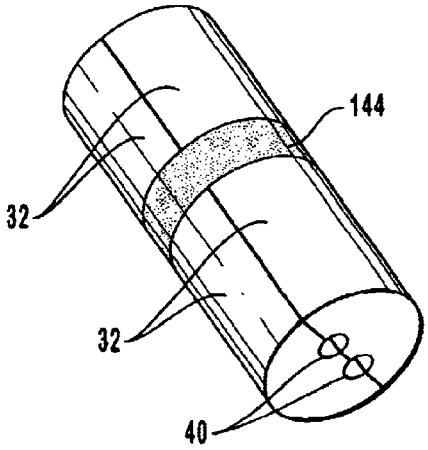
FIG. 16 is a perspective view of an explosive device of the type illustrated in FIGS. 5–7A, wherein the charge segments are secured in an assembled relationship using a third approach.

FIG. 16 shows the use of a third approach to performing the function of assembly means. The circumferences of charge segments 32 are partially covered by a band 144. Band 144 may be formed from any suitable material, such as a rubber, a plastic, cardboard or paper, a metal, string, wire, or cord, a textile material, tape, or an explosive material.

Figure 17:
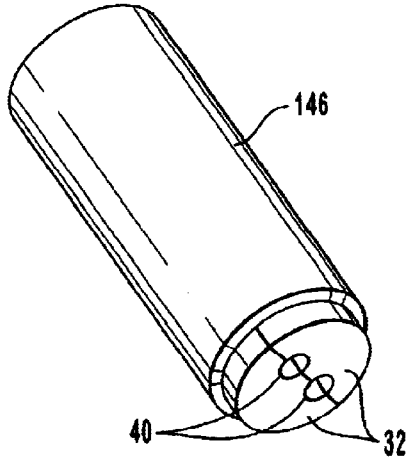
FIG. 17 is a perspective view of an explosive device of the type illustrated in FIGS. 5–7A, wherein the charge segments are secured in an assembled relationship using a fourth approach.

FIG. 17 depicts a fourth approach to performing the function of assembly means wherein charge segments 32 are inserted into a container 146 that covers the circumferences of charge segments 32 to secure charge segments 32 in the assembled relationship. Container 146 may be configured as an open-ended tube that covers only the circumferences of charge segments 32, as a close-ended cylinder, or in another manner that will secure charge segments 32 in the assembled relationship thereof. Container 146 may be formed from any suitable material, such as a rubber, a plastic, cardboard or paper, a metal, cloth, glass, or explosive material.

Figure 18:
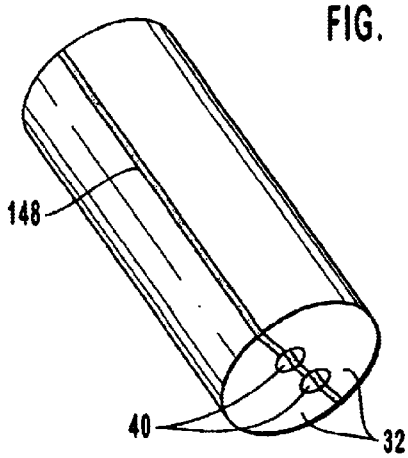
FIG. 18 is a perspective view of an explosive device of the type illustrated in FIGS. 5–7A, wherein the charge segments are secured in an assembled relationship using a fifth approach.

A fifth approach to performing the function of assembly means is illustrated in FIG. 18. In the fifth approach, an adhesive layer 148 is disposed between abutment surfaces 34 to secure charge segments 32 in the assembled relationship. Adhesive layer 148 may be comprised of any adhesive known in the art to secure two or more elements formed of explosive material to each other. For example, adhesive materials such as asphalt or the material known commercially as GLYPTOL may be used as adhesive layer 148.

Although FIGS. 14–18 separately illustrate different approaches to securing explosive charge segments 32 together in the assembled relationship to form segmented explosive device 30, these approaches may also be employed in any combination.

Other approaches to performing the function of assembly means are also within the scope of the present invention, including, without limitation, the use of a label or an external coating.

The assembly means may be used to secure explosive charge segments 32 in the assembled relationship thereof during or after the casting of explosive charge segments 32. For example, explosive charge segments 32 may be assembled in the assembled relationship and the assembly means subsequently secured thereto. As an example of securing assembly means to an explosive charge segment during casting, the assembly means may be disposed within a cavity 66 of first mold half 62 depicted in FIG. 12, and an explosive material disposed within cavity 66. As the explosive material is cast into the configuration of an explosive charge segment 32 or as the explosive material solidifies, the assembly means may be secured to explosive charge segment 32. When explosive charge segment 32 is assembled with another explosive charge segment 32, the assembly means may also be secured to the other explosive charge segment 32.

In yet another aspect of the present invention, as illustrated in FIGS. 19–26, a segmented explosive device incorporating teachings of the present invention may have alternatively configured cavities or passageways, such as cavities 42 and passageways 40 shown in FIG. 5 or channels 76, 77 depicted in FIGS. 7 and 7A.

The cavities or passageways depicted in the charge segments illustrated in FIGS. 19–25 comprise detonation advancement means for permitting a plasma zone to propagate internal of the explosive device ahead of a detonating wave front traveling through the explosive material of the explosive device to explode the explosive material and for initiating a secondary detonating wave front at a location in the explosive material outside and ahead of the detonating wave front. FIGS. 19–25 show, by way of illustration and not limitation, embodiments of structures that can perform the functions of such a detonation advancement means.

Figure 19:
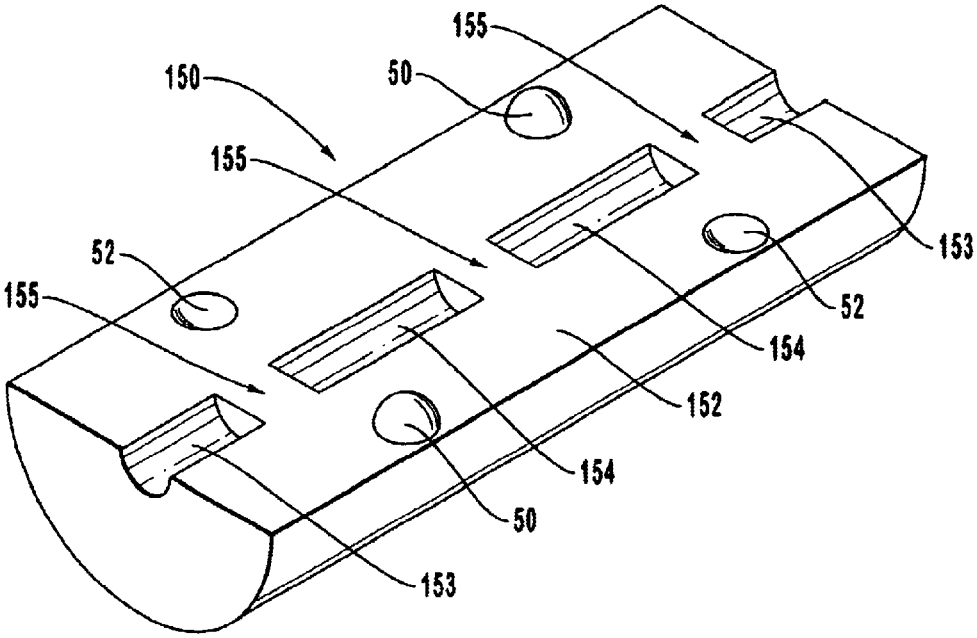
FIG. 19 is a perspective view of a constituent segment of a first embodiment of a prismatic explosive device having structures that are capable of performing the function of detonation advancement means and embodying the teachings of the present invention.

For example, a charge segment can have receptacles located entirely interior of the periphery of the abutment surface thereof. FIG. 19 illustrates a first embodiment of a charge segment 150 with structures that are capable of performing the function of detonation advancement means according to the present invention. Charge segment 150 has an abutment surface 152 formed on a portion of the exterior thereof and cavities 153 and 154 recessed in abutment surface 152 and aligned in a row along abutment surface 152. Cavities 153 extend to an outer periphery of abutment surface 152, while cavities 154 are located within the outer periphery of abutment surface 152. Cavities 153 and cavities 154 are separated from each other by a block 155 of the explosive material of charge segment 150. Charge segment 150 also includes nodules 50 protruding from abutment surface 152 and recesses 52 formed in abutment surface 152. Nodules 50 and recesses 52 are configured to align and mate with complementary recesses and nodules of a second explosive charge segment to be assembled with charge segment 150.

Figure 20:
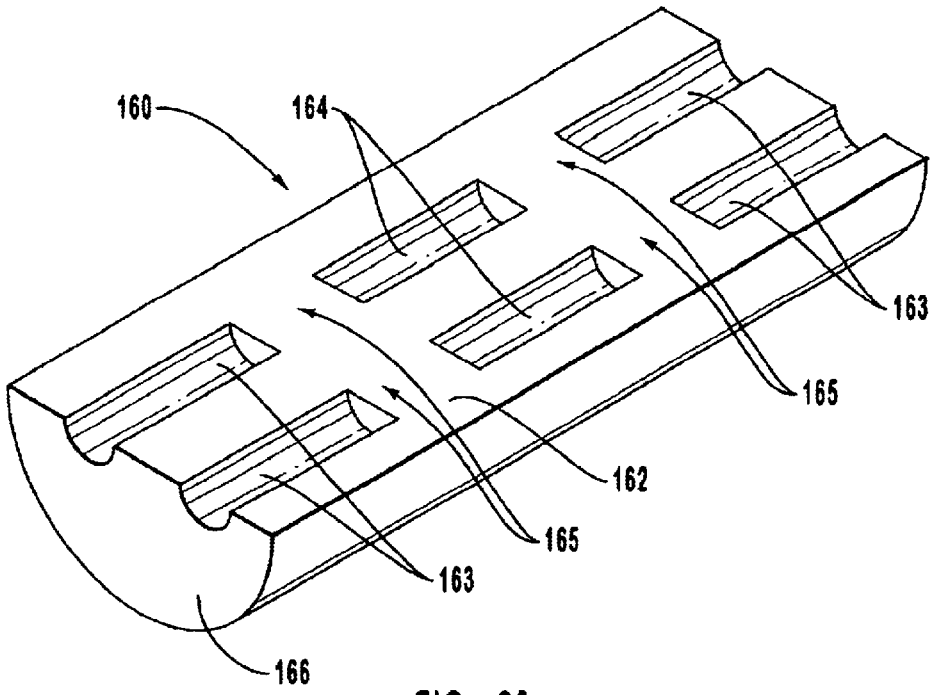
FIG. 20 is a perspective view of a constituent segment of a second embodiment of a prismatic explosive device having structures that are capable of performing the function of detonation advancement means and embodying the teachings of the present invention.

FIG. 20 illustrates a second embodiment of a charge segment 160 with structures that are capable of performing the function of the detonation advancement means. Charge segment 160 has an abutment surface 162 formed on a portion of the exterior thereof. Charge segment 160 also has cavities 163 and 164 recessed in abutment surface 162 and aligned in two parallel rows along abutment surface 162. Cavities 163 extend to an outer periphery of abutment surface 148 and thus are open on an end 166 of charge segment 160. Cavities 163 are separated by a block 165 of the explosive material of charge segment 160 from the adjacent cavities 164.

FIGS. 21A–21F are a series of diagrams illustrating the initiation and propagation of a detonating wave front of an explosive device according to the present invention that includes charge segments 160, the initiation and propagation of a shock wave front through voids in explosive device 160, the propagation of a plasma zone within voids of explosive device 160 ahead of the shock wave front, and the creation of secondary detonating wave fronts as the plasma zone impacts explosive material of explosive device 160.

Figure 21C:
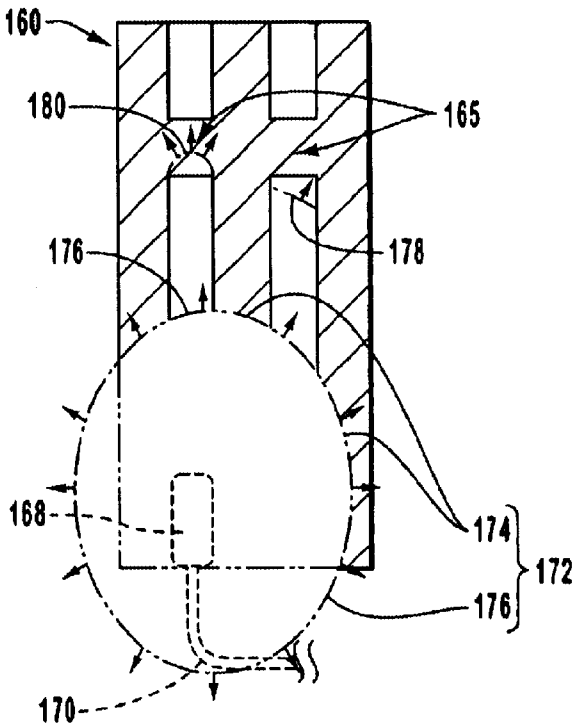
FIGS. 21A–21F are a series of diagrams illustrating the initiation and propagation of a detonating wave front in the explosive device as illustrated in FIG. 19, the propagation of a shock wave front concurrently with the detonating wave front through voids in the explosive device, the propagation of a plasma zone within voids in the explosive device ahead of the shock wave front, the creation of secondary detonating wave fronts as the plasma zone impacts explosive material, and the corresponding development and generation of a shock wave front exterior of the device as a result of the explosion thereof.
Figure 21B:
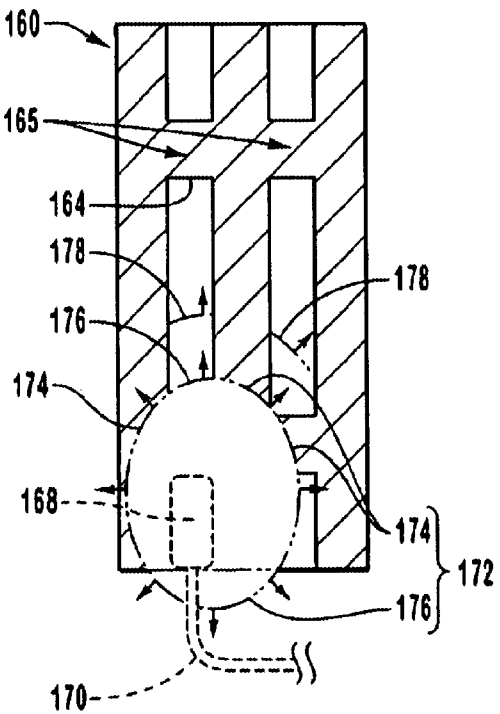
Figure 21A:
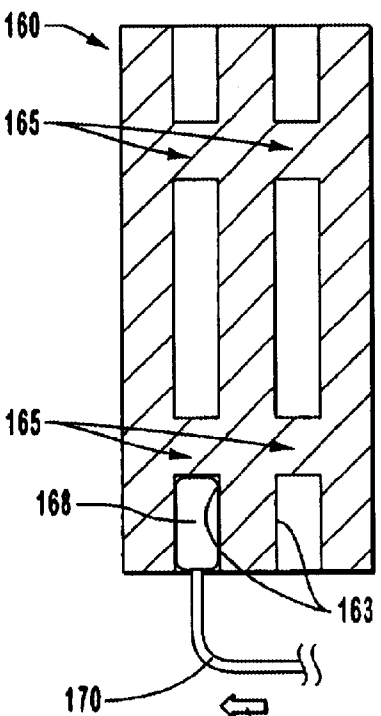

As depicted in FIG. 21A, one of the cavities 163 of explosive charge segment 160 has disposed therein a detonator 168, which is coupled to the output end of a transmission line 170. Transmission line 170 is in turn coupled to a selectively operable control device (not shown in FIGS. 21A–21F).

FIG. 21B illustrates that as the control device is actuated to initiate the detonation of the explosive device, a detonating impulse I travels along transmission line 170 and causes detonator 168 to explode. As detonator 168 explodes, a substantially radial wave front 172 is created, including detonating wave front 174 regions within explosive material and shock wave front 176 regions outside of the explosive material. The detonating wave front 174 regions of wave front 172 travel through the explosive material of charge segments 160, while the shock wave front 176 regions of wave front 172 travel through air surrounding the explosive device or through voids, such as cavities 163, 164, in the explosive device. A plasma zone 178 propagates internal of the explosive device through air or voids, such as cavities 164 in the explosive device ahead of regions of shock wave front 176 propagating within cavities of the explosive device.

FIG. 21C shows that as detonating wave front 174 travels through the explosive material of the explosive device, the explosive material detonates. In addition, as plasma zone 178 impacts a block 165 of explosive material in the path thereof, block 165 detonates ahead of the region of shock wave front 176 that corresponds to plasma zone 178. This detonation of block 165 is referred to as a secondary detonation, and creates a secondary detonating wave front 180 in the explosive material of the explosive device. As is shown in FIG. 21 C, the second detonation of the explosive material of charge segment 160 occurs in advance of shock wave front 176, before shock wave front 176 reaches the location of the second detonation.

Figure 21F:
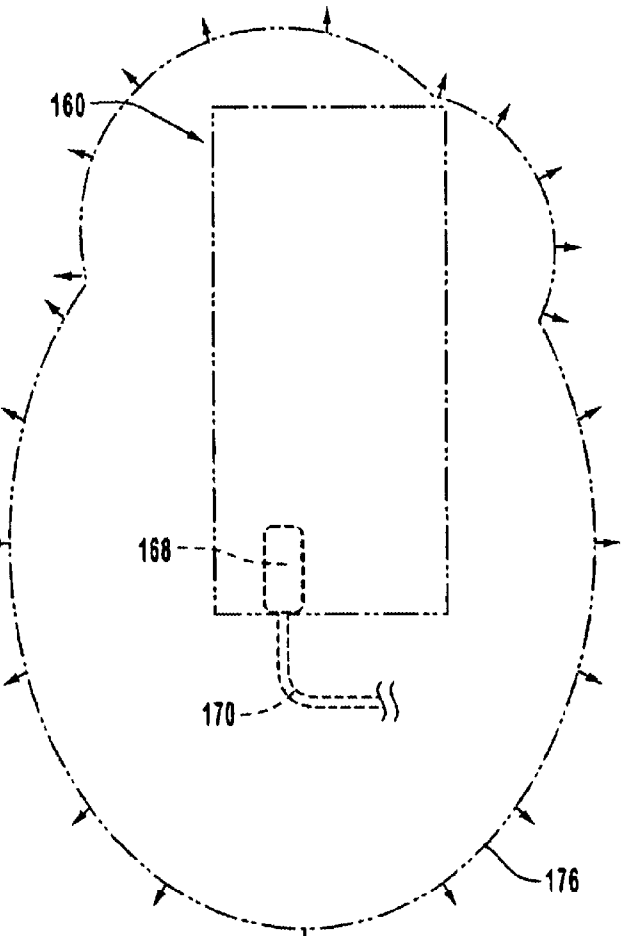
Figure 21E:
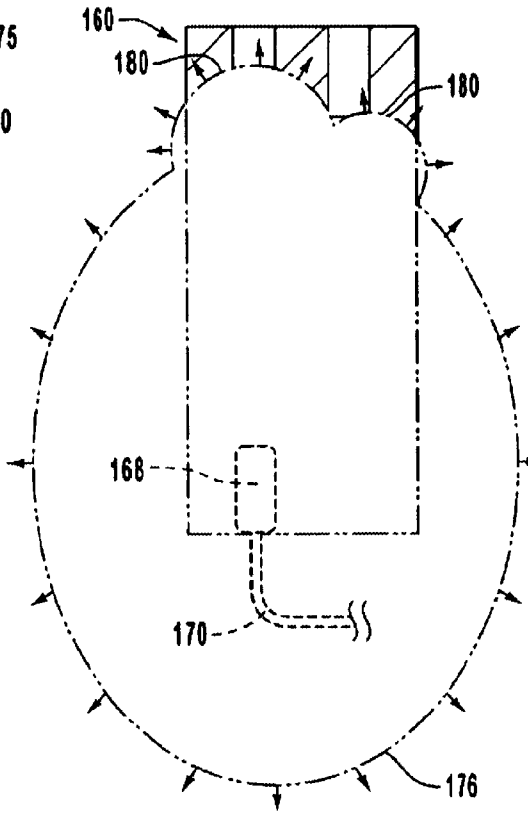
Figure 21D:
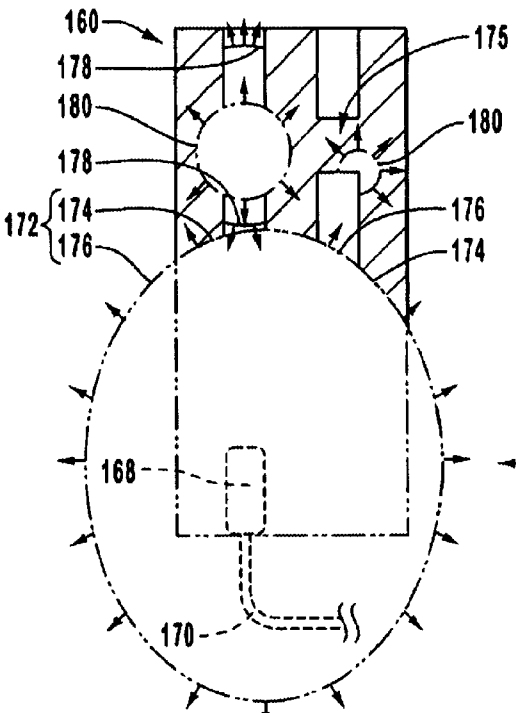

FIGS. 21D–21F illustrate the progression of detonating wave front 174 and secondary detonating wave front 180 through the explosive material of the explosive device. FIG. 21D depicts the formation of a second secondary detonating wave front 180 in the explosive material of the explosive device that includes charge segment 160. In FIG. 21E, shock wave front 176 merges with secondary detonating wave fronts 180. FIG. 21F illustrates that shock wave front 176 has not traveled completely through the location of the explosive device prior to the complete detonation of charge segment 160. Thus, it is apparent from FIG. 21F that the creation of one or more secondary detonating wave fronts 180 in explosive charge segment 160 increases the velocity of detonation of an explosive device comprised of two or more explosive charge segments 160. This phenomenon is referred to as "advance detonation."

FIGS. 22–25 illustrate alternative embodiments of explosive charge segments that will similarly facilitate advance detonation of an explosive device comprising these explosive charge segments.

Figure 22:
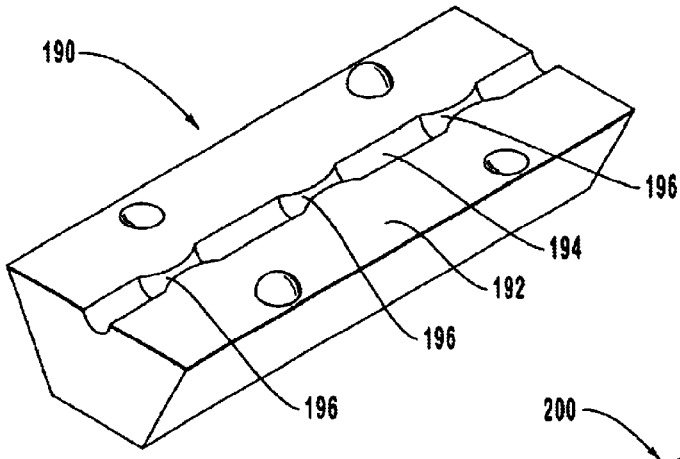
FIG. 22 is a perspective view of a constituent segment of a third embodiment of a prismatic explosive device having structures that are capable of performing the function of detonation advancement means and embodying the teachings of the present invention.

In FIG. 22, a third embodiment of a charge segment 190 having structures that can perform the function of detonation advancement means is illustrated. As illustrated, charge segment 190 has a transverse cross section taken along the length thereof with a trapezoidal configuration. An explosive device with two charge segments 190 will have a hexagonally shaped transverse cross section taken along the length thereof. A portion of the exterior of charge segment 190 forms an abutment surface 192. Charge segment 190 has an elongate cavity 194 recessed in and extending across abutment surface 192. As illustrated, the shape of the transverse cross section taken along the length of cavity 194 changes. Smaller transverse cross sections 196 spaced along the length of cavity 194 facilitate the advance detonation of an explosive device comprised of two or more charge segments 190. The regions of cavity 194 with the smallest transverse cross sections 196 will also contact a transmission line, increasing the efficiency with which a detonation may be initiated at these regions.

Figure 23:
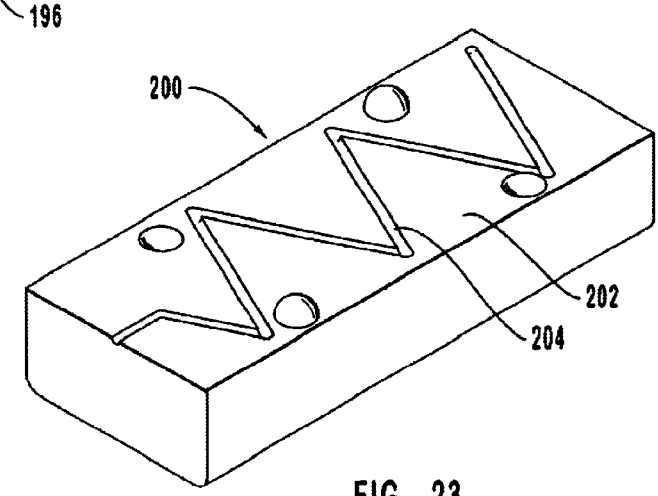
FIG. 23 is a perspective view of a constituent segment of a fourth embodiment of a prismatic explosive device having structures that are capable of performing the function of detonation advancement means and embodying the teachings of the present invention.

A fourth embodiment of a charge segment 200 with structures that are capable of performing the function of detonation advancement means is shown in FIG. 23. The configuration of the transverse cross section of charge segment 200 taken along the length thereof is substantially rectangular. An explosive device formed by the assembly of two charge segments 200 will have a substantially square cross section transverse to the length thereof. Charge segment 200 has an abutment surface 202 formed by a portion of the exterior of charge segment 200. Charge segment 200 also has a non-linear channel 204 recessed in abutment surface 202. The non-linearity of channel 204 facilitates the advance detonation of an explosive device comprising charge segment 200. As illustrated, channel 204 has a zig-zag configuration. Channel 204 is also configured to receive a transmission line and to place the transmission line in contact with the explosive material of charge segment 200, thereby increasing the efficiency with which detonation of the explosive material of charge segment 200 may be initiated. Other non-linear configurations, including, without limitation, serpentine, dove tailed, tongue and groove, and other configurations of cavities or channels, that will facilitate advance detonation and tightly receive a transmission line are also within the scope of the present invention.

Figure 24:
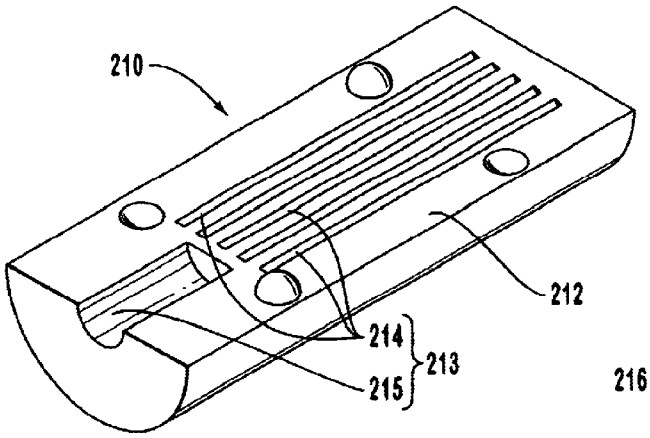
FIG. 24 is a perspective view of a constituent segment of a fifth embodiment of a prismatic explosive device having structures that are capable of performing the function of detonation advancement means and embodying the teachings of the present invention.

FIG. 24 depicts a fifth embodiment of a charge segment 210 having structures that can perform the function of detonation advancement means. Charge segment 210 is semicylindrical and has an abutment surface 212 formed on the diameter of the exterior thereof and has a cavity 213 recessed in abutment surface 212. Cavity 213 has five parallel channels 214, each being located interior of the periphery of abutment surface 214. Cavity 213 also has a semicylindrical receptacle 215 opening on an end of charge segment 210. As a plasma zone impacts the explosive material at the end of each channel 214, secondary detonation of an explosive device that includes charge segment 210 is initiated.

Figure 25:
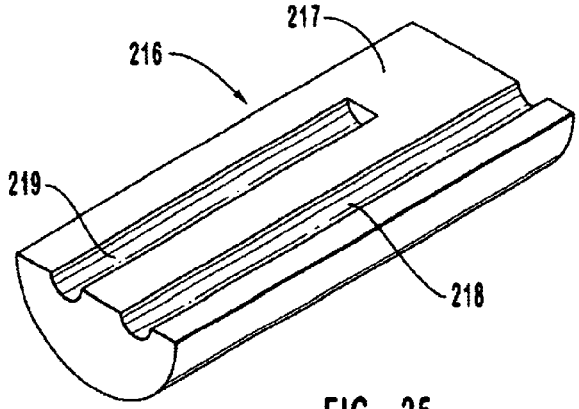
FIG. 25 is a perspective view of a constituent segment of a sixth embodiment of a prismatic explosive device having structures that are capable of performing the function of detonation advancement means and embodying the teachings of the present invention.

A sixth embodiment of a charge segment 216 that has structures capable of performing the function of detonation advancement means is shown in FIG. 25. Charge segment 216 has a semicylindrical configuration with an abutment surface 217 formed on the diameter thereof and two elongate, semicylindrical cavities 218, 219 recessed in abutment surface 217. Cavity 218 traverses the entire length of abutment surface 217, opening on both ends of charge segment 216. Cavity 219 partially traverses the length of abutment surface 217, with a first end opening on an end of charge segment 216 and a second end located interior of the periphery of abutment surface 219.

Figure 26:
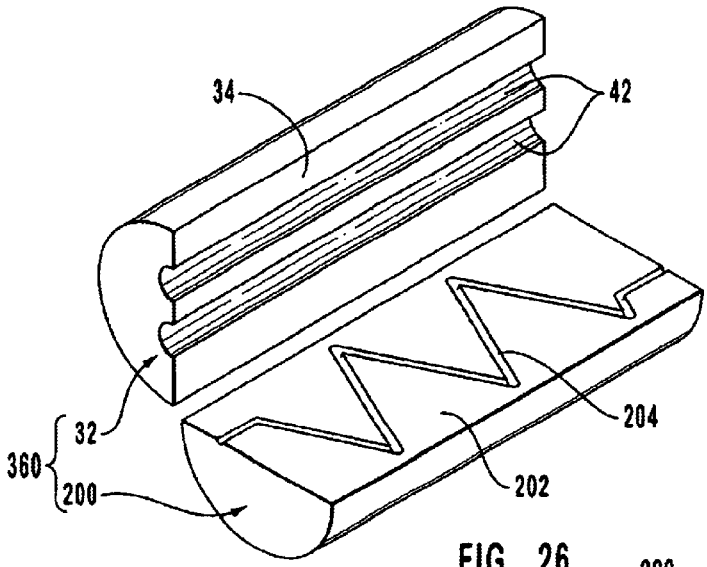
FIG. 26 is a disassembled perspective view of the constituent components of a cylindrical explosive embodying the teachings of the present invention and having non-mirroring cavities when the constituent components are disposed in an assembled relationship.

According to yet another aspect of the present invention, two charge segments having non-congruent cavities recessed into the abutment surfaces thereof can be assembled so that the cavities are positioned in a non-mirroring relationship. FIG. 26 illustrates a disassembled cylindrical segmented explosive device 360 with two semicylindrical charge segments 32 and 200, each having structures that can perform the function of detonation advancement means. Each charge segment 32, 200 has an abutment surface 34, 202 formed on the diameter thereof. Abutment surface 34 has two elongate cavities 42 recessed therein. As illustrated, first cavities 42 are semicylindrical channels traversing the length of abutment surface 34. Abutment surface 202 has recessed therein a second cavity 204 of different configuration than cavity 42. As illustrated in FIG. 26, second cavity 204 is a non-linear channel.

Upon disposing charge segment 32 and charge segment 200 in an assembled relationship, with abutment surface 34 in contact with abutment surface 202, first cavity 42 is positioned in a non-mirroring relationship across abutment surfaces 32, 202 relative to second cavity 204. Regions of first cavity 42 and second cavity 204 communicate with each other. In FIG. 26 the areas at which first cavity 42 and second cavity 204 communicate are located interior of the peripheries of abutment surfaces 34, 202.

According to another aspect of the present invention, FIGS. 27–33D illustrate an explosive charge segment made of more than just a single type of explosive material. This type of charge segment will be referred to hereinafter as a composite charge segment. An explosive device that includes a composite charge segment will be referred to hereinafter as a composite explosive device. Composite charge segments include a first explosive material and a more sensitive second explosive material.

Figure 27:
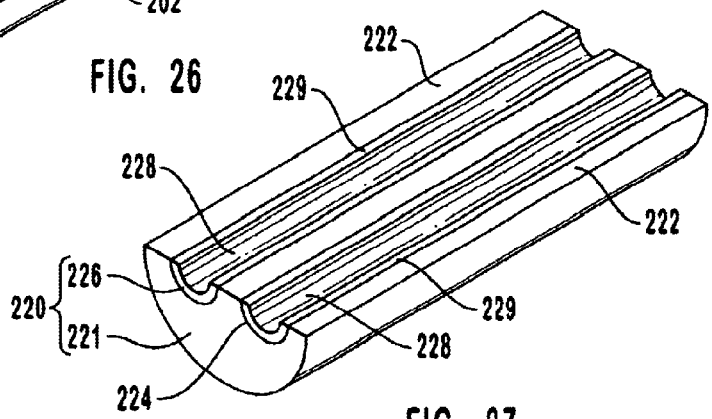
FIG. 27 is a perspective view of a constituent segment of a first embodiment of a prismatic composite explosive device embodying the teachings of the present invention.

FIG. 27 illustrates a first embodiment of a composite charge segment 220, a portion of the exterior of which forms an abutment surface 222. Charge segment 220, has a body 221 with two elongate cavities 224 recessed in and extending parallel to each other across abutment surface 222. Each cavity 224 has disposed therein and in substantial contact therewith an inlay 226 with a C-shaped cross-section. Inlay 226 has an inlay cavity 228 recessed in an inlay abutment surface 229. Inlay abutment surface 229 is disposed in the plane of abutment surface 222.

Figure 28:
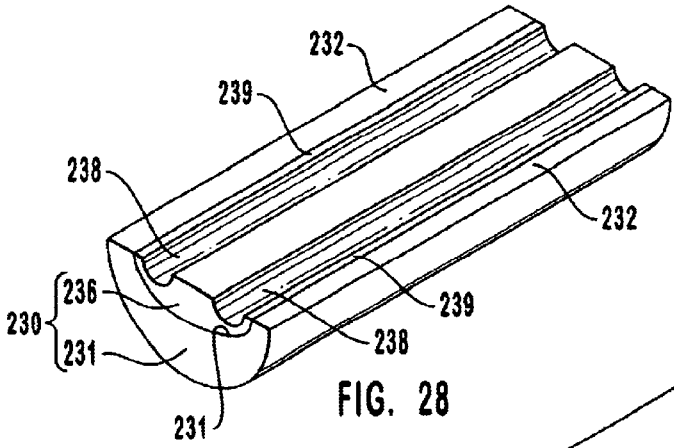
FIG. 28 is a perspective view of a constituent segment of a second embodiment of a prismatic composite explosive device embodying the teachings of the present invention.

A second embodiment of a composite charge segment 230 is depicted in FIG. 28. Charge segment 230 has a body 231 with an abutment surface 232 formed on a portion of the exterior of body 231 and a cavity 234 recessed in and extending across abutment surface 232. Charge segment 230 also has an inlay 236 comprised of a second explosive material and having an inlay abutment surface 239 and two elongate, parallel inlay cavities 238 recessed in inlay abutment surface 239. Inlay 236 is disposed within cavity 234. Inlay abutment surface 239 is disposed in the same plane as abutment surface 232 of charge segment 230.

Figure 29:
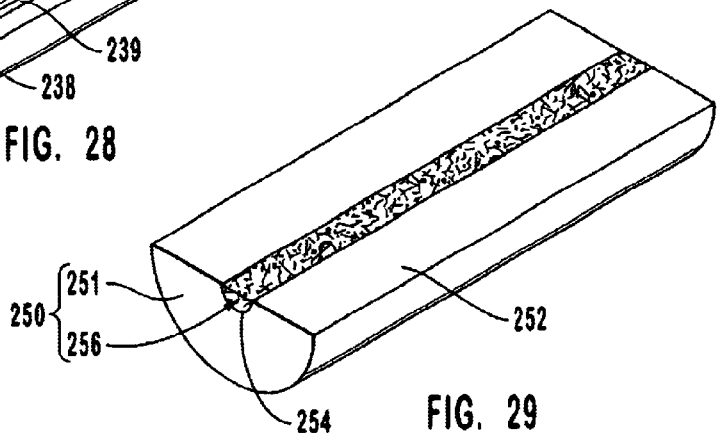
FIG. 29 is a perspective view of a constituent segment of a third embodiment of a prismatic composite explosive device embodying the teachings of the present invention.

A third embodiment of a composite charge segment 250, shown in FIG. 29, has a body 251 comprised of a first explosive material and having an abutment surface 252 formed on a portion of the exterior thereof. A cavity 254 is recessed in and traverses abutment surface 252. Charge segment 250 also has a quantity of a more sensitive second explosive material 256 disposed within cavity 254. As illustrated in FIG. 29, the second explosive material 256 is particulate. Second explosive material 256 may alternatively comprise a semicylindrical insert of a substantially solid second explosive material.

Figure 30:
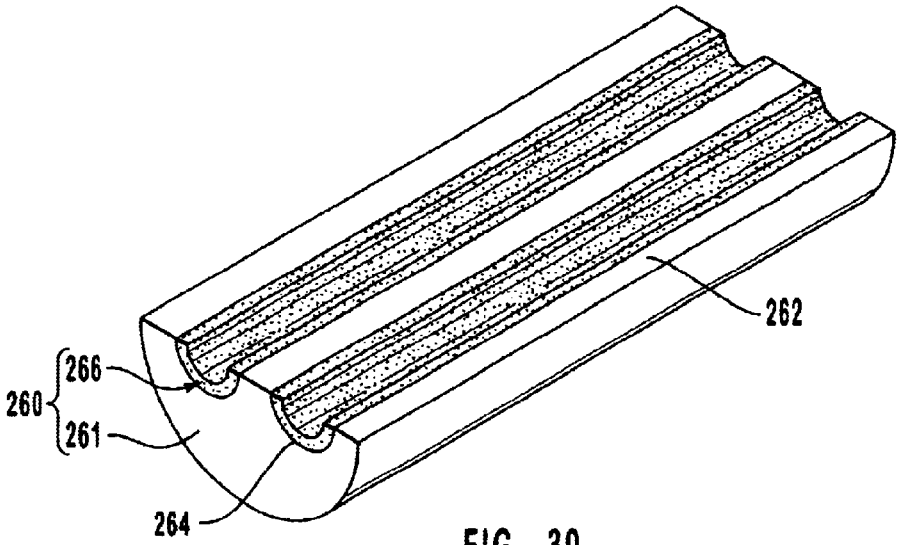
FIG. 30 is a perspective view of a constituent segment of a fourth embodiment of a prismatic composite explosive device embodying the teachings of the present invention.

A fourth embodiment of a composite charge segment 260 is illustrated in FIG. 30. Charge segment 260 includes a body 261 comprised of a first explosive material and having an exterior which forms an abutment surface 262. Elongate cavities 264 are recessed in abutment surface 262. Cavities 264 are coated with a layer of a second explosive material to form an inlay layer 266 of charge segment 260.

Figure 31:
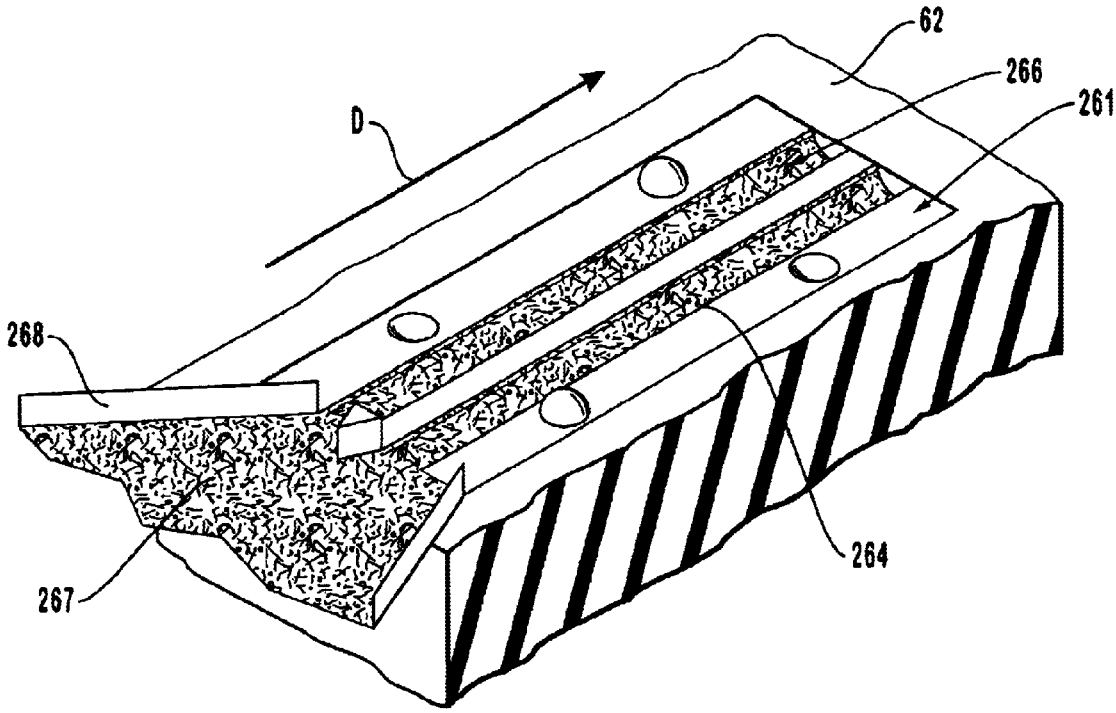
FIG. 31 is a perspective view of a manufacturing method used to produce a constituent segment of an explosive device of the type illustrated in FIG. 30.

FIG. 31 illustrates a method by which cavities 264 of body 261 may be coated with an inlay layer 266 of second explosive material. While body 261 remains within first mold half 62, and before the first explosive material of body 261 has completely solidified, particles of second explosive material 267 are disposed by a hopper 268 into cavities 264 as first mold half 62 is transported in the direction of arrow D. As the first explosive material of body 261 has not yet completely solidified, the particulate second explosive material of inlay layer 266 adheres to the first explosive material exposed at the surfaces of cavities 264. When the first explosive material of body 261 solidifies, inlay layers 266 are secured within cavities 264.

Figure 32:
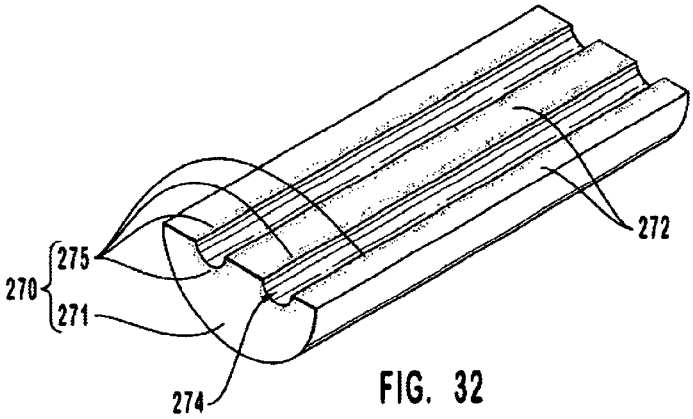
FIG. 32 is a perspective view of a constituent segment of a fifth embodiment of a prismatic composite explosive device embodying the teachings of the present invention.

FIG. 32 illustrates a fifth embodiment of a composite charge segment 270 formed of a first quantity 271 of first explosive material and having an abutment surface 272 formed by a portion of the exterior thereof and cavities 274 recessed in abutment surface 272. Cavities 274 are lined with second quantity 275 of a second explosive material, which is diffused with an adjacent portion of first quantity 271 of the first explosive material of charge segment 270.

Figure 33A:
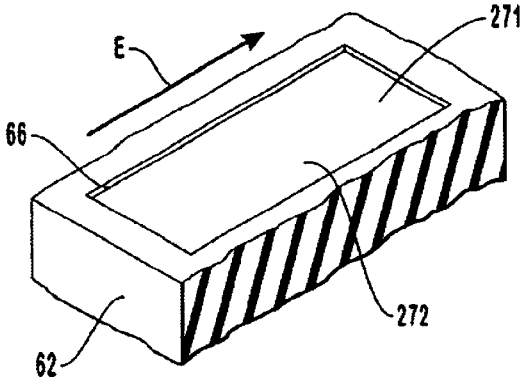
FIGS. 33A–33D are a series of diagrams providing perspective views of the steps of a manufacturing method to produce a constituent segment of an explosive device of the type illustrated in FIG. 32.
Figure 33B:
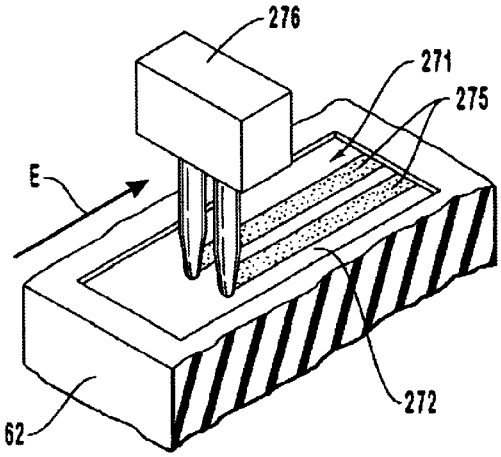
Figure 33C:
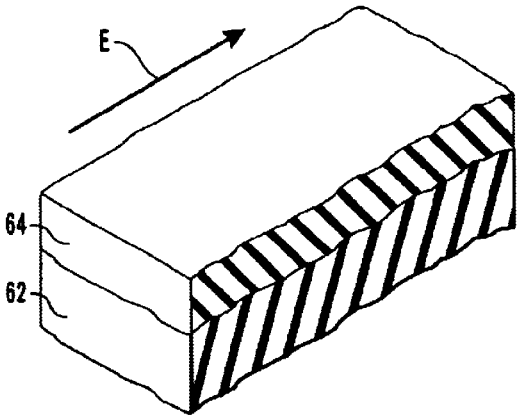
Figure 33D:
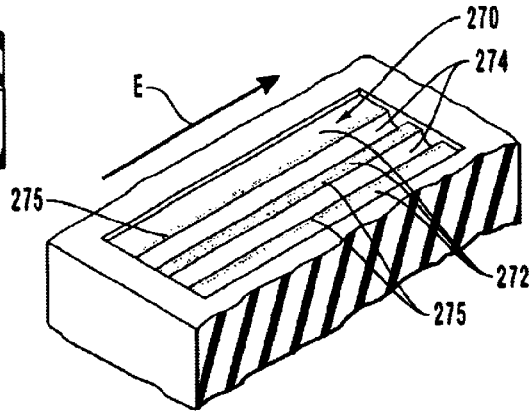

An example of a method that may be used to manufacture explosive charge segment 270 is depicted in FIGS. 33A–33D. As illustrated in FIG. 33A, as first mold half 62 is transported in the direction of arrow E, a molten first quantity 271 of the first explosive material is disposed within cavity 66 of first mold half 62 with abutment surface 272 being exposed. As first mold half 62 continues to travel in the direction of arrow E, a second quantity 275 of molten second explosive material is then disposed from a dispenser 276 upon regions of abutment surface 272 in which cavities 274 will be formed, as shown in FIG. 33B. Next, a second mold half 64 is disposed over first mold half 62 and assembled with first mold half 62, as depicted in FIG. 33C, to form cavities 274 lined with second explosive material 275 in abutment surface 272, as shown in FIG. 33D.

Figure 34:
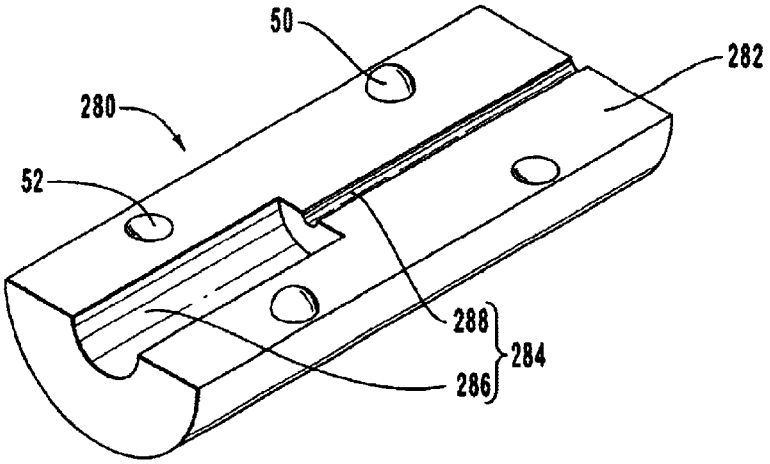
FIG. 34 is a perspective view of a constituent segment of an embodiment of a prismatic explosive device embodying the teachings of the present invention and having a receptacle opening on a first end of the segment, and a channel communicating with the receptacle and opening on a second end of the segment.

FIG. 34 illustrates an embodiment of a semicylindrical charge segment 280 having an abutment surface 282 on the diameter thereof and a cavity 284 recessed in abutment surface 282. Cavity 284 has a semicylindrical receptacle 286 that extends to the periphery of abutment surface 282 and opens on the end of charge segment 280. Cavity 284 also has a smaller, narrower, semicylindrical channel 288 that communicates with receptacle 286. Channel 288 traverses abutment surface 282, extending to the periphery thereof and opening on an end of charge segment 280. Charge segment 280 also has two male nodules 50 protruding from abutment surface 282 and two female recesses 52 formed in abutment surface 282.

Figure 35:
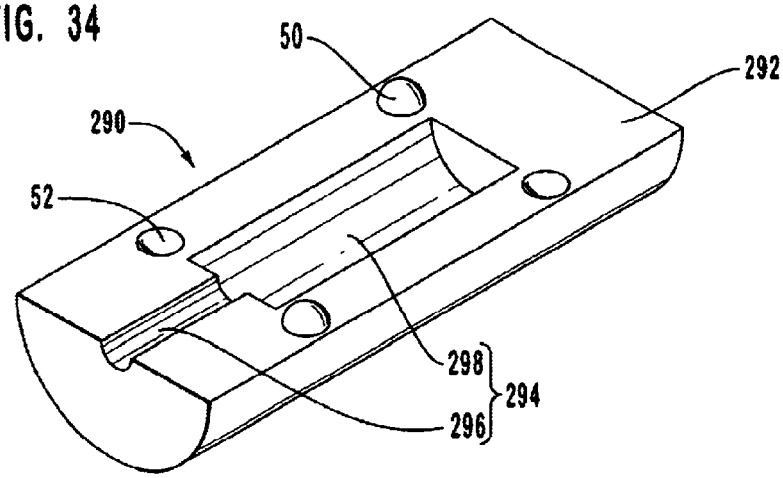
FIG. 35 is a perspective view of a constituent segment of an embodiment of a cylindrical explosive device embodying the teachings of the present invention and having a receptacle interior of a periphery of the abutment surface thereof and a channel communicating with the receptacle and opening on an end of the segment.

Charge segment 290, depicted in FIG. 35, has a semicylindrical configuration, with an abutment surface 292 formed on the diameter thereof. Charge segment 290 also has a cavity 294 recessed in abutment surface 292. Cavity 294 has a semicylindrical receptacle 296 located interior of the periphery of abutment surface 292. Cavity 294 also has a smaller, narrower semicylindrical channel 298 traversing across abutment surface 292 in communication with receptacle 296 and opening on an end of charge segment 290. Cavities of the type shown in FIG. 35 cannot be formed internal of explosive devices by conventional manufacturing processes. Charge segment 290 also has two male nodules 50 protruding from abutment surface 292 and two female recesses 52 formed in abutment surface 292. Nodules 50 and recesses 52 are situated upon abutment surface 292 in a similar manner to the nodules 50 and recesses 52 of charge segment 32 shown in FIG. 6.

Figure 36:
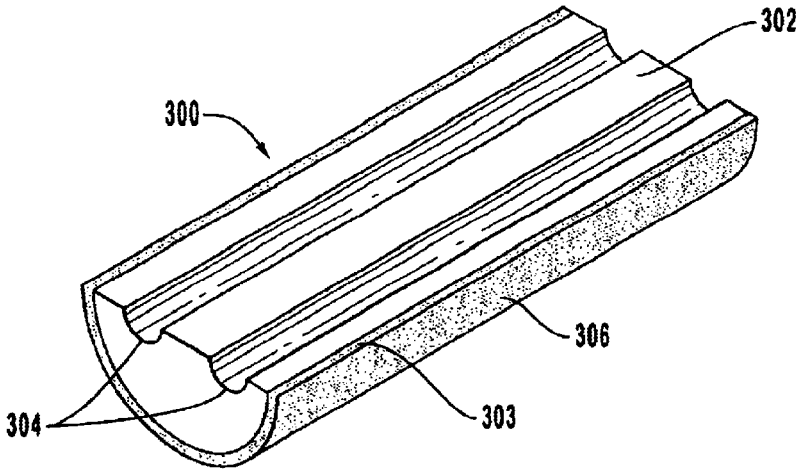
FIG. 36 is a perspective view of a constituent segment of an embodiment of a prismatic explosive embodying the teachings of the present invention and having a casing on an external surface thereof.

FIG. 36 illustrates a semicylindrical explosive charge segment 300 with an abutment surface 302 formed on the diameter thereof and an external surface 303 formed on the circumference of charge segment 300. Charge segment 300 also has two elongate, semicylindrical, parallel cavities 304 traversing thereacross. Both ends of each cavity 304 open to opposite ends of charge segment 300. A casing 306 of a non-explosive, protective material, such as a lacquer, a plastic, a wax, wax paper, kraft paper, or cardboard, is disposed in contact with exterior surface 303.

Figure 37A:
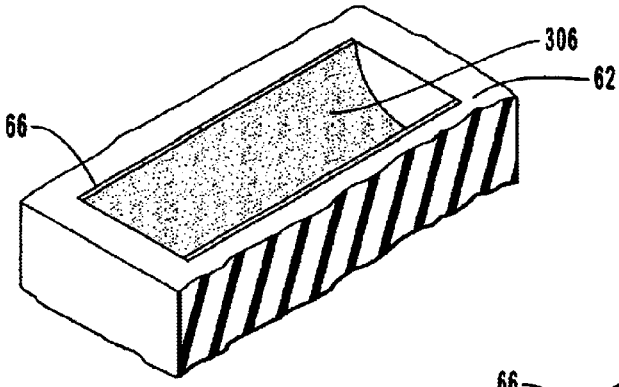
FIGS. 37A and 37B are sections of a mold in perspective view illustrating a method for manufacturing a constituent segment of the type illustrated in FIG. 36.
Figure 37B:
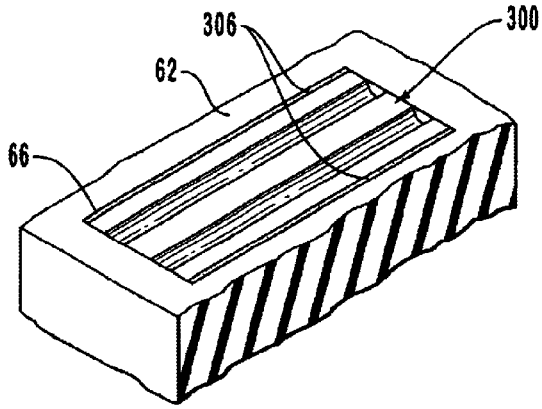

One method by which explosive charge segment 300 can be manufactured is illustrated in FIGS. 37A and 37B. FIG. 37A shows the application of a layer of casing material to the surface of a cavity 66 of a first mold half 62 of the type illustrated in FIG. 12 to form casing 306. If the material of casing 306 is a material such as a lacquer, a plastic, or a wax, the casing material may be applied to the surface of cavity 66 by spraying, with a brush, by disposing a pre-formed casing 306 or a layer of casing material in cavity 66 against the surface thereof, or by any other application technique. Wax paper, kraft paper, and cardboard are applied to the surface of cavity 66 by disposing a layer of the casing material against the surface of cavity 66. FIG. 37B illustrates the disposal of an explosive material into cavity 66 and the formation of the explosive material into the configuration of a charge segment 300, such as by the process disclosed in reference to FIG. 13.

Figure 38:
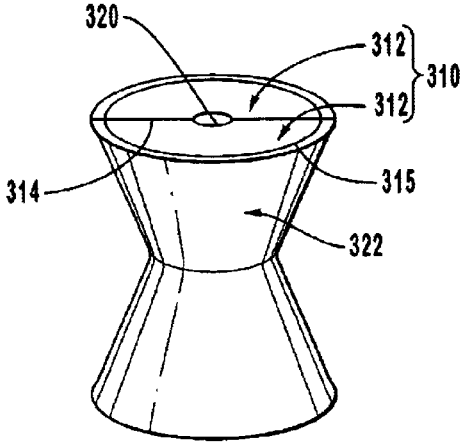
FIG. 38 is a perspective view of a first embodiment of a non-prismatic explosive device embodying the teachings of the present invention.

FIG. 38 illustrates a first embodiment of a non-prismatic, segmented explosive device 310. Explosive device 310 includes a pair of elongated explosive charge segments 312.

The transverse cross section of each charge segment 312 assumes a semicircular configuration that varies in size with the location of the cross section along the length of charge segment 312. The transverse cross section is smallest at the center of the length of charge segment 312 and largest at the ends of, charge segment 312 increasing gradually therebetween, from the center of charge segment 312 with the outward taper thereof.

Each charge segment 312 has an abutment surface 314 formed by the diameters of the semicircles of the transverse cross sections of charge segment 312. The circumferences of the semicircular cross sections form an external surface 315 of charge segment 312. When abutment surfaces 314 are disposed against each other in an assembled relationship, as illustrated in FIG. 38, explosive device 310 has an hourglass configuration.

Each charge segment 312 has a liner 322 in contact with the external surface 315 thereof. Liner 322 is made of metal or of a metal impregnated material, such as a metal impregnated plastic. Liners 322 are known in the art to increase the density of explosive devices and, thereby, to improve the penetration of the shock wave front into explosive material or a formation surrounding the explosive device.

Figure 39:
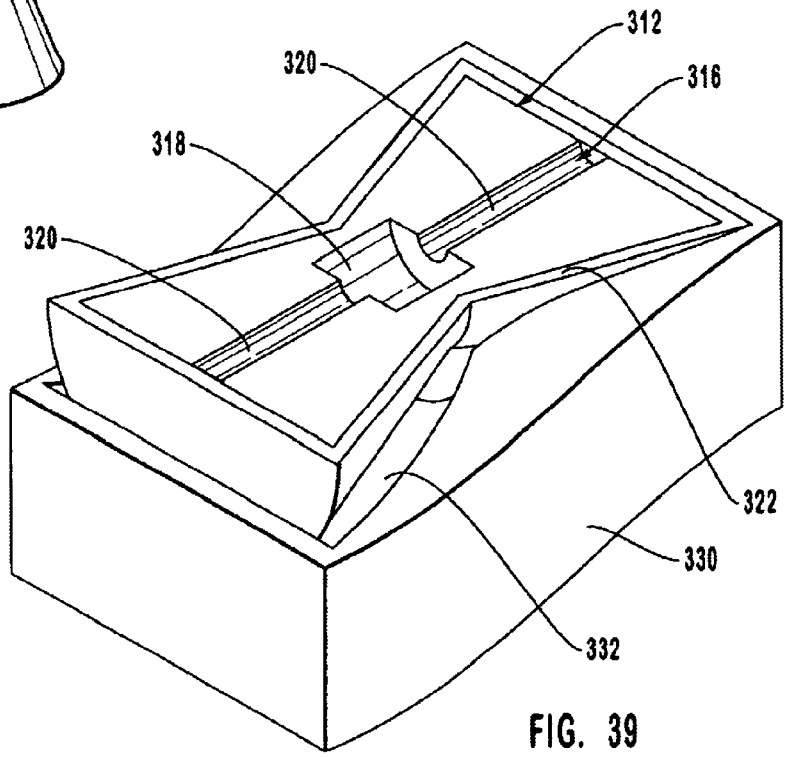
FIG. 39 is a perspective view of a manufacturing method to produce a constituent segment of an explosive device of the type illustrated in FIG. 38.

As depicted in FIG. 39, a cavity 316 is recessed in abutment surface 314 of each explosive charge segment 312. Cavity 316 has a semicylindrical receptacle 318 located interior of the periphery of abutment surface 314. Such an interior receptacle 318 cannot be formed by conventional processes for manufacturing explosive devices. Cavity 316 also has two smaller, narrower semicylindrical channels 320, one channel 320 communicating with each end of receptacle 318. Channels 320 traverse abutment surface 314 and open on opposite ends of charge segment 312.

FIG. 39 also illustrates a method by which each charge segment 312 may be manufactured. Liner 322 is disposed adjacent to the surface of a cavity 332 of a flexible mold 330, such as a silicone mold. An explosive material is then disposed in cavity 332 and formed into the shape of charge segment 312, such as by the process disclosed in reference to FIG. 13. Charge segment 312 is then removed from mold 330 by peeling mold 330 off of charge segment 312.

Figure 40:
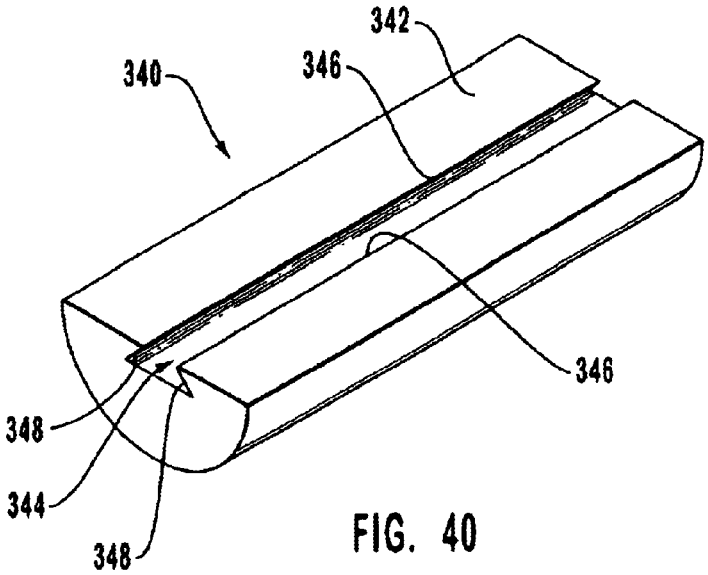
FIG. 40 is a perspective view of a constituent segment of an embodiment of a prismatic explosive embodying the teachings of the present invention and having a cavity with undercut regions therein.

FIG. 40 illustrates an embodiment of a prismatic explosive charge segment 340 that has a semicylindrical configuration with an abutment surface 342 formed on the diameter thereof. Charge segment 340 also has an elongate cavity 344 recessed in abutment surface 342. A shoulder 346 is formed at the edge between each side of cavity 344 and abutment surface 342. Cavity 344 has an undercut 348 on each side thereof, beneath shoulder 346. Cavities with undercuts 348 may be fabricated by using a flexible mold of the type depicted in and described with reference to FIG. 39.

Figure 41:
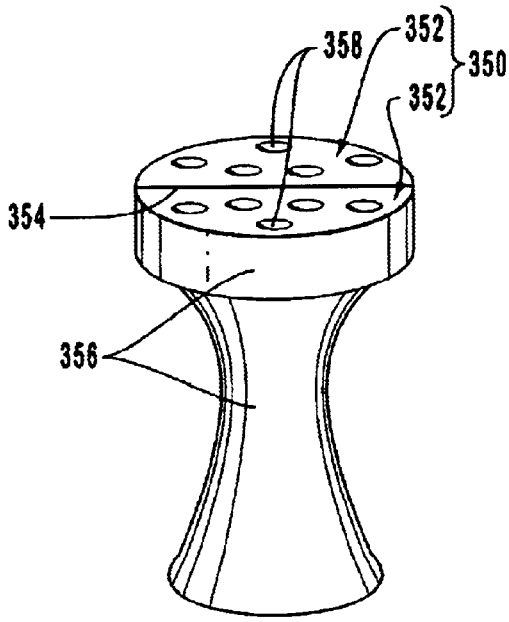
FIG. 41 is a perspective view of a second embodiment of a non-cylindrical explosive device embodying the teachings of the present invention.

A second embodiment of a non-prismatic, segmented explosive device 350 is depicted in FIG. 41. Explosive device 350 has two elongated explosive charge segments 352. The transverse cross section of each charge segment 352 taken along the length thereof has a semicircular configuration and a changing size along the length of charge segment 352. Each charge segment 352 has an abutment surface 354 formed by the diameters of the semicircles of the transverse cross sections of charge segment 352. The circumferences of the semicircular cross sections form an external surface 356 of charge segment 352. One end of each charge segment 352 has indentations 358 recessed therein.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An explosive device of the type capable of producing exterior thereto a shock wave front sufficiently powerful to produce useful work suitable to the customary needs of at least one of mining, construction, and seismic activities, said explosive device being exploded by a detonation impulse generated by a selectively operable control device and communicated to said explosive device from the output end of a transmission line coupled between the control device and said explosive device, said explosive device comprising:

(a) an explosive first charge segment comprised of an explosive material, said first charge segment being of a size sufficient to contribute when detonated to producing exterior thereto a shock wave front suitable to the customary needs of at least one of mining, construction, and seismic activities, said first charge segment comprising:

(i) a first abutment surface formed on a portion of the exterior of said first charge segment;

(ii) a first external surface formed on the remainder of the exterior of said first charge segment; and (iii) a transmission line receiving cavity recessed in said first abutment surface, said transmission line receiving cavity being configured to receive the output end of a transmission line;

(b) an explosive second charge segment comprised of said explosive material, said second charge segment being of a size sufficient to contribute when detonated to producing exterior thereto a shock wave front suitable to the customary needs of at least one of mining, construction, and seismic activities, said second charge segment comprising:

(i) a second abutment surface formed on a portion of the exterior of said second charge segment, said second abutment surface being disposed against said first abutment surface in an assembled relationship of said first and second charge segments; and (ii) a second external surface formed on the remainder of the exterior of said second charge segment;

(c) assembly means for securing said first charge segment and said second charge segment in said assembled relationship thereof, in said assembled relationship and with the output end of the transmission line disposed in said receiving cavity, said first charge segment and said second charge segment being detonated together by a detonation impulse communicated to the output end of the transition line, thereby to function as a single explosive device and produce a shock wave front capable of effecting useful work suitable to the needs of at least one of mining, construction, and seismic activities; and (d) detonation advancement means located between said first and second charge segments in said assembled relationship thereof, said detonation advancement means functioning:

(i) for permitting a plasma zone to propagate internal of said explosive device ahead of a detonation wave front traveling through said explosive material of said charge segments to explode said explosive device; and (ii) for initiating a secondary detonation wave front at a location in said explosive material of said charge segments ahead of said detonation wave front traveling through said explosive material.

2. An explosive device as recited in claim 1, wherein said transmission line receiving cavity comprises an elongated channel traversing said first abutment surface.

3. An explosive device comprising:

(a) an explosive first charge segment comprised of an explosive material, said first charge segment comprising a first abutment surface formed on a portion of the exterior of said first charge segment; and (b) an explosive second charge segment comprised of said explosive material, said second charge segment comprising:

(i) a second abutment surface formed on a portion of the exterior of said second charge segment, said second abutment surface being disposed against said first abutment surface in an assembled relationship of said first and second charge segments; and (ii) an elongated non-linear detonation enhancement cavity recessed in said second abutment surface, whereby when said explosive device is exploded a plasma zone propagated in said detonation enhancement cavity ahead of the detonation wavefront traveling through said explosive material of said charge segments initiates a secondary detonation wavefront at a surface of said detonation enhancement cavity at a location in said explosive material ahead of said detonation wavefront traveling therethrough.

4. An explosive device as recited in claim 2, wherein said transmission line receiving channel is linear.

5. An explosive device as recited in claim 4, wherein the configuration of the transverse cross section of said transmission line receiving channel is unchanging along the length thereof.

6. An explosive device as recited in claim 1, wherein said first and second charge segments are each elongated.

7. An explosive device as recited in claim 6, wherein the configuration of the transverse cross section of each of the first and second charge segments is unchanging along the length thereof.

8. An explosive device as recited in claim 7, wherein said first charge segment has a semicylindrical shape with said first abutment surface formed on the diameter of said first charge segment and with said first external surface formed on the circumference and ends of said first charge segment.

9. An explosive device as recited in claim 8, wherein said second charge segment has a semicylindrical shape with said second abutment surface formed on the diameter of said second charge segment and with said second external surface formed on the circumference and ends of said second charge segment.

10. An explosive device as recited in claim 9, wherein said assembly means substantially covers the circumference of said first and second charge segments.

11. An explosive device as recited in claim 10, wherein said ends of said first and second charge segments are at least partially exposed through said assembly means.

12. An explosive device as recited in claim 6, wherein said assembly means covers the ends of said first and second charge segments.

13. An explosive device as recited in claim 1, wherein said assembly means comprises an adhesive bonding said first abutment surface to said second abutment surface.

14. An explosive device of the type capable of producing a shock wave front upon being exploded by a detonation impulse generated by a selectively operable control device and communicated to said explosive device from the output end of a transmission line coupled between the control device and said explosive device, said explosive device comprising:

(a) an elongated explosive first charge segment comprised of an explosive material and having a transverse cross section with an unchanging configuration along the length of said first charge segment, said first charge segment comprising:

(i) a planar first abutment surface formed on a portion of the exterior of said first charge segment; and (ii) an elongated first detonation enhancement cavity recessed in said first abutment surface, the transverse cross section of said first detonation enhancement cavity having an unchanging configuration along the length thereof and a closed end located interior of the periphery of said first abutment surface; and (b) an elongated explosive second charge segment comprised of said explosive material and having a transverse cross section with an unchanging configuration along the length of said second charge segment, said second charge segment comprising:

(i) a planar second abutment surface formed on a portion of the exterior of said second charge segment, said second abutment surface being congruent to said first abutment surface, said second abutment surface being disposed against said first abutment surface in an assembled relationship of said first and second charge segments; and (ii) an elongated second detonation enhancement cavity recessed in said second abutment surface and, the transverse cross sections of said second detonation enhancement cavity having an unchanging configuration along the length thereof and a closed end located interior of said second abutment surface, said second detonation enhancement cavity being so located in said second abutment surface that in said assembled relationship of said first and second charge segments said first detonation enhancement cavity and said second detonation enhancement cavity are disposed in mirroring opposition, communicating therebetween over the full extent thereof to form a corresponding void with a closed end in said explosive device, whereby when said explosive device is exploded by receiving through the output end of the transmission line a detonation impulse from the control device, a plasma zone propagating in said void ahead of the detonation wavefront traveling through said explosive material of said charge segments initiates a secondary detonation wavefront at a surface of said void at a location in said explosive material ahead of said detonation wavefront traveling therethrough.

15. An explosive device as recited in claim 14, further comprising assembly means for securing said first charge segment and said second charge segment in said assembled relationship thereof.

16. An explosive device as recited in claim 14, wherein in said assembled relationship said first abutment surface and said second abutment surface form an interface between said first and second charge segments.

17. An explosive device as recited in claim 14, wherein said first abutment surface has a texture.

18. An explosive device of the type capable of producing a shock wave front upon being exploded by a detonation impulse generated by a selectively operable control device and communicated to said explosive device by the output end of a transmission line coupled between the control device and said explosive device, said explosive device comprising:

(a) an explosive semicylindrical first charge segment comprised of an explosive material, said first charge segment comprising:
  (i) an abutment surface formed on the diameter of the exterior of said first charge segment;
  (ii) an external surface formed on the circumference of the exterior of said first charge segment;
  (iii) a semicylindrical elongated first cavity recessed in said abutment surface traversing the length of said abutment surface, the diameter of said first cavity being located in the plane of said abutment surface; and
  (iv) a semicylindrical elongated second cavity recessed in said abutment surface, the diameter of said second cavity being located in the plane of said abutment surface;

(b) an explosive semicylindrical second charge segment comprised of said explosive material, said second charge segment comprising:
  (i) an abutment surface formed on the diameter of the exterior of said second charge segment, said abutment surface of said second charge segment being disposed against said abutment surface of said first charge segment in an assembled relationship of said first and second charge segments;
  (ii) an external surface formed on the circumference of the exterior of said second charge segment;
  (iii) a semicylindrical elongated first cavity recessed in said abutment surface traversing the length of said abutment surface, the diameter of said first cavity being located in the plane of said abutment surface, in said assembled relationship of said first and second charge segments said first cavity of said first charge segment and said first cavity of said second charge segment being disposed in mirroring opposition, communicating therebetween over the full extent thereof to form a cylindrical first passageway in said explosive device so configured as to be capable of receiving the output end of the transmission line coupled to the control device and thereover a detonation impulse from the control device for exploding said explosive device; and
  (iv) a semicylindrical elongated second cavity recessed in said abutment surface, the diameter of said second cavity being located in the plane of said abutment surface, in said assembled relationship of said first and second charge segments said second cavity of said first charge segment and said second cavity of said second charge segment being disposed in mirroring opposition, communicating therebetween over the full extent thereof to form a cylindrical second passageway in said explosive device; and (c) detonation advancement means located between said first and second charge segments in said assembled relationship thereof, said detonation advancement means functioning:
  (i) for permitting a plasma zone to propagate internal of said explosive device ahead of a detonation wave front traveling through said explosive material of said charge segments to explode said explosive device; and
  (ii) for initiating a secondary detonation wave front at a location in said explosive material of said charge segments ahead of said detonation wave front traveling through said explosive material.

19. An explosive device as recited in claim 18, wherein said first charge segment further comprises:

(a) a first member comprised of said explosive material having a first adjoinment surface distinct from said abutment surface and from said external surface of said first charge segment; and (b) a second member comprised of said explosive material having a second adjoinment surface congruent to said first adjoinment surface, said second adjoinment surface distinct from said abutment surface and from said external surface of said first charge segment, said second member being juxtaposed to said first member with said first adjoinment surface opposed to said second adjoinment surface and in mating engagement therewith.

20. An explosive device as recited in claim 19, wherein said first and second adjoinment surfaces extend along a plane located along the length of said first charge segment.

21. An explosive device as recited in claim 19, wherein said first and second adjoinment surfaces extend along a plane located transverse to the length of said first charge segment.

22. An explosive device of the type capable of producing a shock wave front upon being exploded by a detonation impulse generated by a selectively operable control device and communicated to said explosive device by the output end of a transmission line coupled between the control device and said explosive device, said explosive device comprising:

(a) identically configured explosive first and second charge segments disposed in an assembled relationship, each of said charge segments comprised of an explosive material, each of the charge segments comprising:
  (i) an abutment surface formed on a portion of the exterior of the explosive charge segment, in said assembled relationship said abutment surface of each of said explosive charge segments being disposed against each other;
  (ii) a semicylindrical elongated first cavity recessed in said abutment surface traversing said abutment surface, the diameter of said first cavity being located in the plane of said abutment surface, in said assembled relationship said first cavity of each of said explosive charge segments being disposed in mirroring opposition, communicating therebetween over the full extent thereof to form an enclosed cylindrical first passageway in said explosive device so configured as to be capable of receiving a length of the transmission line coupled to the control device; and
  (iii) a semicylindrical elongated second cavity recessed in said abutment surface traversing said abutment surface parallel to said first cavity, the diameter of said second cavity being located in the plane of said abutment surface, in said assembled relationship said second cavity of each of said charge segments being disposed in mirroring opposition, communicating therebetween over the full extent thereof to form an enclosed cylindrical second passageway in said explosive device so configured as to be capable of receiving the output end of the transmission line coupled to the control device and thereover a detonation impulse from the control device for exploding said explosive device; and (b) detonation advancement means located between said first and second charge segments in said assembled relationship thereof, said detonation advancement means functioning:
  (i) for permitting a plasma zone to propagate internal of said explosive device ahead of a detonation wave front traveling through said explosive material of said charge segments to explode said explosive device; and (ii) for initiating a secondary detonation wave front at a location in said explosive material of said charge segments ahead of said detonation wave front traveling through said explosive material.

23. An explosive device as recited in claim 22, further comprising male-female mating means associated with each of said abutment surfaces for facilitating and stabilizing the disposition of said charge segments in said assembled relationship thereof.

24. An explosive device as recited in claim 3, wherein said detonation enhancement channel includes a bend along the length thereof.

25. An explosive device as recited in claim 1, wherein said transmission line receiving cavity opens on the periphery of said first abutment surface.

26. An explosive device as recited in claim 25, wherein said transmission line receiving cavity comprises:

(a) a receptacle recessed in said first abutment surface and being capable of receiving a detonator activatable by a detonation impulse from the control device; and (b) a channel recessed in said first abutment surface communicating between said receptacle and said periphery of said first abutment surface, said channel being configured to receive the output end of a transmission line for a detonation impulse from the control device.

27. An explosive device as recited in claim 1, wherein said receptacle is located interior of said periphery of said first abutment surface.

28. An explosive device as recited in claim 1, further comprising a second channel recessed in said first abutment surface communicating with said receptacle and opening on said periphery of said first abutment surface.

29. An explosive device as recited in claim 1, wherein said receptacle opens on said periphery of said first abutment surface.

30. An explosive device as recited in claim 1, wherein said detonation advancement means comprises a detonation enhancement cavity recessed in said first abutment surface interior of the periphery of said first abutment surface.

31. An explosive device as recited in claim 30, wherein said detonation enhancement cavity comprises a plurality of parallel channels formed in said first abutment surface.

32. An explosive device as recited in claim 31, wherein said plurality of parallel channels comprises more than four channels.

33. An explosive device as recited in claim 1, wherein said detonation advancement means comprises a detonation enhancement cavity recessed in said first abutment surface, said detonation enhancement cavity opening on an edge of said first abutment surface.

34. An explosive device as recited in claim 33, wherein said detonation enhancement cavity comprises a channel traversing said first abutment surface, the configuration of the transverse cross section of said channel changing along the length thereof.

35. An explosive device as recited in claim 1, wherein an edge of said transmission line receiving cavity at a junction with said first abutment surface interior of the periphery thereof forms a shoulder of said transmission line receiving cavity.

36. An explosive device as recited in claim 35, wherein said transmission line receiving cavity has an undercut region beneath said shoulder.

37. An explosive device as recited in claim 35, wherein said shoulder separates said transmission line receiving cavity from a detonation enhancement cavity of said first charge segment recessed in said first abutment surface.

38. An explosive device as recited in claim 3, wherein said first and second charge segments are each elongated.

39. An explosive device as recited in claim 1, wherein the configuration of the transverse cross section of said first charge segment changes along the length thereof.

40. An explosive device as recited in claim 39, wherein the ends of said first abutment surface are wider than the center of said first abutment surface.

41. An explosive device as recited in claim 40, wherein a peripheral edge of said first abutment surface tapers outward from the center of said first abutment surface to the ends thereof.

42. An explosive device as recited in claim 41, wherein said first abutment surface has an hourglass shape.

43. An explosive device as recited in claim 1, further comprising indentations formed in said first external surface of said first charge segment.

44. An explosive device as recited in claim 14, further comprising male-female mating means associated with each of said first abutment surface and said second abutment surface for facilitating and stabilizing the disposition of said first and second explosive charge segments in said assembled relationship thereof.

45. An explosive device as recited in claim 44, wherein said male-female mating means comprises:

(a) a nodule protruding from said first abutment surface; and (b) a recess formed in said second abutment surface, in said assembled relationship said recess configured to receive said nodule.

46. An explosive device as recited in claim 44, wherein said male-female mating means comprises:

(a) a recess formed in said first abutment surface; and (b) a nodule protruding from said second abutment surface, in said assembled relationship said nodule being configured to be received by said recess.

47. An explosive device as recited in claim 22, further comprising assembly means for securing said first charge segment and said second charge segment in said assembled relationship thereof.

48. An explosive device as recited in claim 1, further comprising a casing disposed on the exterior of said explosive device.

49. An explosive device as recited in claim 3, wherein the configuration of the transverse cross section of said channel narrows at a location along the length thereof.

50. An explosive device as recited in claim 3, wherein said first abutment surface has texturing.

51. An explosive device as recited in claim 50, wherein said channel comprises recessed areas of said texturing located between raised areas of said texturing.

52. An explosive device comprising:

(a) an explosive first charge segment comprised on an explosive material, said first charge segment comprising:

(i) a first abutment surface formed on a portion of the exterior of said first charge segment; and (ii) a first cavity recessed in said first abutment surface; and (b) an explosive second charge segment comprised of said explosive material, said second charge segment comprising:

(i) a second abutment surface formed on a portion of the exterior of said second charge segment, said second abutment surface being disposed against said first abutment surface in an assembled relationship of said first and second charge segments; and (ii) a second cavity recessed in said second abutment surface in said assembled relationship, said second cavity being positioned in a non-mirroring relationship in said second abutment surface relative to said first cavity in said first abutment surface; and (c) detonation advancement means located between said first and second charge segments in said assembled relationship thereof, said detonation advancement means functioning:

(i) for permitting a plasma zone to propagate internal of said explosive device ahead of a detonation wave front traveling through said explosive material of said charge segments to explode said explosive device; and (ii) for initiating a secondary detonation wave front at a location in said explosive material of said charge segments ahead of said detonation wave front traveling through said explosive material.

53. An explosive device as recited in claim 52, wherein in said assembled relationship said first cavity communicates with said second cavity interior of the periphery of said first abutment surface and interior of the periphery of said second abutment surface.

54. An explosive device of the type capable of producing a shock wave front upon being exploded by a detonation impulse generated by a selectively operable control device and communicated to said explosive device from the output end of a transmission line coupled between the control device and said explosive device, said explosive device comprising:

(a) an explosive first charge segment comprised of an explosive material, said first charge segment comprising:

(i) a first abutment surface formed on a portion of the exterior of said first charge segment;

(ii) a first external surface formed on the remainder of the exterior of said first charge segment; and (iii) a transmission line receiving cavity recessed in said first abutment surface, said transmission line receiving cavity being configured to receive the output end of the transmission line;

(b) an explosive second charge segment comprised of said explosive material, said second charge segment comprising:

(i) a second abutment surface formed on a portion of the exterior of said second charge segment, said second abutment surface being disposed against said first abutment surface in an assembled relationship of said first and second charge segments; and (ii) a second external surface formed on the remainder of the exterior of said second charge segment;

(c) assembly means for securing said first charge segment and said second charge segment in said assembled relationship thereof; and (d) detonation advancement means located between said first and second charge segments in said assembled relationship thereof, said detonation advancement means functioning:

(i) for permitting a plasma zone to propagate internal of said explosive device ahead of a detonation wave front traveling through said explosive material of said explosive device to explode said explosive device; and (ii) for initiating a secondary detonation wave front at a location in said explosive material of said explosive device ahead of said detonation wave front traveling through said explosive material.

55. An explosive device as recited in claim 54, wherein said detonation advancement means comprises an elongated channel recessed in said second abutment surface, said channel having a closed end located interior of the periphery of said first abutment surface.

56. An explosive device as recited in claim 55, wherein said channel is non-linear.

57. An explosive device as recited in claim 56, wherein the configuration of the transverse cross section of said channel is unchanging along the length thereof.

58. An explosive device as recited in claim 56, wherein the configuration of the transverse cross section of said channel changes along the length thereof.

59. An explosive device as recited in claim 55, wherein said channel is linear.

60. An explosive device as recited in claim 59, wherein the configuration of the transverse cross section of said channel is unchanging along the length thereof.

61. An explosive device as recited in claim 59, wherein the configuration of the transverse cross section of said channel changes along the length thereof.

62. An explosive device as recited in claim 55, wherein said detonation advancement means comprises a plurality of parallel elongated channels, each of said plurality of channels being located interior of the periphery of said second abutment surface.

63. An explosive device of the type capable of producing a shock wave front upon being exploded by a detonation impulse generated by a selectively operable control device and communicated to said explosive device from the output end of a transmission line coupled between the control device and said explosive device, said explosive device comprising:

(a) an explosive first charge segment comprised of an explosive material, said first charge segment comprising a first abutment surface formed on a portion of the exterior of said first charge segment;

(b) an explosive second charge segment comprised of said explosive material, said second charge segment comprising:

(i) a second abutment surface formed on a portion of the exterior of said second charge segment, said second abutment surface being disposed against said first abutment surface in an assembled relationship of said first and second charge segments; and (ii) texture on said second abutment surface, said texture comprising:

(A) a plurality of raised areas; and (B) a plurality of recessed areas interposed between adjacent of said raised areas, said recessed areas resulting in voids within said explosive device when said first charge segment and said second charge segment are in said assembled relationship thereof, whereby when said explosive device is exploded a plasma zone propagated in said recessed areas of said texture ahead of the detonation wavefront passing through said explosive material of said charge segments initiates a secondary detonation wavefront at a surface of said texture at a location in said explosive material ahead of said detonation wavefront traveling therethrough; and (c) assembly means for securing said first charge segment and said second charge segment in said assembled relationship thereof.

64. An explosive device as recited in claim 63, wherein said recessed areas open on the periphery of said second abutment surface.

65. An explosive device as recited in claim 63, wherein said recessed areas cumulatively traverse said explosive device in a direction substantially parallel to the longitudinal axis of said second abutment surface.

66. An explosive device as recited in claim 63, wherein said recessed areas cumulatively traverse said explosive device substantially parallel to the latitudinal axis of said second abutment surface.

67. An explosive device as recited in claim 63, further comprising a transmission line receiving cavity between said charge segments opening to the exterior of said explosive device and configured to receive the output end of a detonation impulse transmission line operably coupled to a selectively operable detonation control device, wherein said recessed areas on opposite sides of said receiving cavity communicate through said receiving cavity, thereby together traversing said explosive device in a direction substantially parallel to said latitudinal axis of said second abutment surface.

68. An explosive device as recited in claim 63, further comprising a texture on said first abutment surface of said second charge segment.

69. An explosive device as recited in claim 68, wherein said texture on said first abutment surface comprises:

(a) a plurality of raised areas; and (b) a plurality of recessed areas interposed between adjacent of said raised areas, said recessed areas resulting in voids within said explosive device when said first charge segment and said second charge segment are in said assembled relationship thereof.

70. An explosive device as recited in claim 69, wherein said raised areas of said texture on said second abutment surface engage said raised areas of said texture on said first abutment surface in said assembled condition of said first and second charge segments.

71. An explosive device of the type capable of producing a shock wave front upon being exploded by a detonation impulse generated by a selectively operable control device and communicated to said explosive device, said explosive device comprising:

(a) an explosive first charge segment comprised of an explosive material, said first charge segment comprising:

(i) a first abutment surface formed on a portion of the exterior of said first charge segment; and (ii) a cavity recessed in said first abutment surface and opening on the periphery thereof, said cavity comprising:

(A) a receptacle recessed in said first abutment surface and configured to receive a detonator activatable by a detonation impulse from the control device; and (B) a channel recessed in said first abutment surface communicating between said receptacle and said periphery of said first abutment surface, said channel being configured to receive the output end of a transmission line for a detonation impulse from the control device;

(b) an explosive second charge segment comprised of said explosive material, said second charge segment comprising a second abutment surface formed on a portion of the exterior of said second charge segment, said second abutment surface being disposed against the first abutment surface in an assembled relationship of said first and second charge segments; and (c) detonation advancement means located between said first and second charge segments in said assembled relationship thereof, said detonation advancement means functioning:

(i) for permitting a plasma zone to propagate internal of said explosive device ahead of a detonation wave front traveling through said explosive material of said charge segments to explode said explosive device; and (ii) for initiating a secondary detonation wave front at a location in said explosive material of said charge segments ahead of said detonation wave front traveling through said explosive material.

72. An explosive device as recited in claim 71, wherein the lateral cross section of said receptacle is semicircular.

73. An explosive device as recited in claim 72, wherein the lateral cross section of said channel is semicircular.

74. An explosive device as recited in claim 73, wherein the longitudinal axis of said receptacle is coincident with the longitudinal axis of said channel.

75. An explosive device as recited in claim 73, wherein the longitudinal axis of said receptacle is parallel to the longitudinal axis of said channel.

76. An explosive device as recited in claim 71, further comprising:

(a) a detonator disposed in said cavity and activatable by a detonation impulse from the control device; and (b) a transmission line traversing the longitudinal extent of said channel from said receptacle to said periphery of said first abutment surface, said transmission line having an output end coupled to said detonator and an input end capable of receiving a detonation impulse from the control device being located exterior of said periphery of said first abutment surface.

77. An explosive device as recited in claim 76, wherein said transmission line comprises a detonating cord.

78. An explosive device as recited in claim 76, wherein said transmission line comprises a shock tube.

79. An explosive device as recited in claim 76, wherein said transmission line comprises an electrically conductive wire.

80. An explosive device as recited in claim 76, wherein said detonator is trapped in said cavity in said assembled relationship of said first and second charge segments.

81. An explosive device as recited in claim 71, wherein the lateral extend of said channel is smaller than the lateral extent of said receptacle.

82. An explosive device as recited in claim 71, wherein said receptacle opens on said periphery of said first abutment surface.

83. An explosive device as recited in claim 71, wherein said receptacle is recessed in said first abutment surface interior of said periphery thereof.

84. An explosive device as recited in claim 14, further comprising a transmission line receiving cavity formed between said first and second explosive charge segments in said assembled relationship thereof, said transmission line receiving cavity being configured to receive the output end of the transmission line.

85. An explosive device as recited in claim 14, wherein said first and second detonation enhancement cavities are linear.

86. An explosive device as recited in claim 14, wherein said first and second detonation enhancement cavities include a bend along the longitudinal extend thereof.

87. An explosive device as recited in claim 22. wherein said detonation enhancement means comprises texture on said first abutment surface.

88. An explosive device as recited in claim 87, wherein said texture on said first abutment surface comprises cross hatching formed into said first abutment surface.

89. An explosive device as recited in claim 18, wherein said second cavity of said first charge segment is oriented parallel to said first cavity of said first charge segment, and said second cavity of said second charge segment is oriented generally parallel to said first cavity of said second charge segment, whereby said second passageway in said explosive device is oriented generally parallel to said first passageway in said explosive device.

90. An explosive device as recited in claim 18, wherein said detonation advancement means comprises:

(a) a closed end in said second cavity of said first charge segment; and (b) a closed end in said second cavity of said second charge segment, whereby said second passageway in said explosive device has a closed end interior thereof.

91. An explosive device as recited in claim 18, wherein said detonation advancement means comprises:

(a) said second cavity of said first charge segment being formed interior of the periphery of said abutment surface of said first charge segment; and (b) said second cavity of said second charge segment being formed interior of the periphery of said abutment surface of said second charge segment, whereby said second passageway in said explosive device is interior thereof.

92. An explosive device as recited in claim 18, wherein said detonation advancement means comprises texturing on said abutment surface of said first charge segment and on said abutment surface of said second charge segment, said texturing comprising:

(a) a plurality of raised areas; and (b) a plurality of recessed areas interposed between adjacent of said raised areas, said recessed areas resulting in voids within said explosive device when said first charge segment and said second charge segment are in said assembled relationship thereof.

93. An explosive device as recited in claim 92, wherein:

(a) said recessed areas on opposite sides of said first cavity of said first charge segment communicate through said first cavity of said first charge segment, thereby together traversing said explosive device in a direction substantially parallel to the latitudinal axis thereof; and (b) said recessed areas on opposite sides of said first cavity of said second charge segment communicate through said first cavity of said second charge segment, thereby together traversing said explosive device in a direction substantially parallel to the latitudinal axis thereof.

94. An explosive device as recited in claim 52, wherein said detonation advancement means comprises a closed end provided for said first cavity.

95. An explosive device as recited in claim 52, wherein said detonation advancement means comprises said first cavity being formed interior of the periphery of said first abutment surface.

96. An explosive device as recited in claim 52, wherein said detonation advancement means comprises texturing on said first abutment surface, said texturing comprising:

(a) a plurality of raised areas;

(b) a plurality of recessed areas interposed between adjacent of said raised areas, said recessed areas resulting in voids within said explosive device when said first charge segment and said second charge segment are in said assembled relationship thereof.

97. An explosive device as recited in claim 52, wherein said detonation advancement means comprises a region of reduced transverse cross section in said first cavity along the length thereof.

98. An explosive device as recited in claim 52, wherein said detonation advancement means comprises a bend in said first cavity along the length thereof.

99. An explosive device as recited in claim 22, further comprising a liner in contact with the exterior of said explosive device in said assembled relationship of said first and second charge segments.

100. An explosive device as recited in claim 99, wherein said liner is comprised of a nonexplosive material.

101. An explosive device as recited in claim 100, wherein said liner is comprised of metal.

102. An explosive device as recited in claim 99, wherein said liner permeates into said explosive material of said first and second charge segments adjacent to the exterior of said explosive device.

103. An explosive device comprising:

(a) an explosive first charge segment comprised of an explosive material, said first explosive charge segment comprising a first abutment surface formed on a portion of the exterior of said first charge segment; and (b) an explosive second charge segment comprised of said explosive material, said second charge segment comprising:

(i) a second abutment surface formed on a portion of the exterior of said second charge segment, said second abutment surface being disposed against said first abutment surface in an assembled relationship of said first and second charge segments; and (ii) a cavity recessed in said second abutment surface interior said periphery thereof, whereby when said explosive device is exploded a plasma zone propagated in said cavity ahead of the detonation wavefront traveling through said explosive material of said charge segments initiates a secondary detonation wavefront at a surface of said cavity at a location in said explosive material ahead of said detonation wavefront traveling therethrough.

104. An explosive device as recited in claim 103, further comprising a transmission line receiving cavity recessed in said first abutment surface opening on an edge thereof and configured to receive the output end of a detonation impulse transmission line operably coupled to a selectively operable detonation control device.

105. An explosive device as recited in claim 103, further comprising assembly means for securing said first and second charge segments in said assembled relationship thereof.

106. An explosive device as recited in claim 103, wherein:

(a) said first charge segment further comprises an inlay receptacle recessed in said first abutment surface; and (b) said explosive device further comprises an inlay received in said inlay receptacle and comprised of an explosive inlay material different from said explosive material of said first and second charge segments, said inlay having an inlay abutment surface on the exterior of said inlay, and said inlay abutment surface being disposed in the plane of said first abutment surface.

107. An explosive device as recited in claim 106, wherein said explosive inlay material adjacent to the exterior of said inlay diffuses into said first explosive material adjacent to said inlay receptacle.

108. An explosive device as recited in claim 106, wherein said explosive inlay material of said inlay is a particulate explosive material.

109. An explosive device as recited in claim 106, wherein an edge of said inlay abutment surface coincides with an edge of said first abutment surface, and said first charge segment further comprises a transmission line receiving cavity recessed in said inlay abutment surface opening on said edge of said inlay abutment surface at said edge of said first abutment surface and configured to receive the output end of a detonation impulse transmission line operably coupled to a selectively operable control device.

110. An explosive device as recited in claim 109, wherein said transmission line receiving cavity comprises an elongated channel.

111. An explosive device as recited in claim 106, wherein said explosive inlay material has enhanced detonation sensitivity relative to said explosive material of said first and second charge segments.

112. An explosive device as recited in claim 106, wherein an edge of said inlay abutment surface coincides with an edge of said first abutment surface, and said first charge segment further comprises a plurality of elongated channels recessed in said inlay abutment surface, one of said channels opening on said edge of said inlay abutment surface at said edge of said first abutment surface and configured to receive the output end of a detonation impulse transmission line operably coupled to a selectively operable control device.

113. An explosive device as recited in claim 112, wherein channels of said plurality of elongated channels are parallel to each other.

114. An explosive device as recited in claim 103, further comprising:

(a) a detonator disposed in said transmission line receiving cavity and activatable by a detonation impulse from the control device; and (b) a transmission line having an output end coupled to said detonator and an input end capable of receiving a detonation impulse from the control device being located exterior of said periphery of said first abutment surface.

* * * * *